US007387860B2

(12) United States Patent
Moriki et al.

(10) Patent No.: US 7,387,860 B2
(45) Date of Patent: Jun. 17, 2008

(54) TONER, AND IMAGE FORMING METHOD

(75) Inventors: Yuji Moriki, Shizuoka-ken (JP); Shinya Yachi, Shizuoka-ken (JP); Yushi Mikuriya, Shizuoka-ken (JP); Keiji Komoto, Shizuoka-ken (JP); Kenichi Nakayama, Shizuoka-ken (JP); Takeshi Kaburagi, Shizuoka-ken (JP); Emi Tosaka, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/758,408

(22) Filed: Jun. 5, 2007

(65) Prior Publication Data

US 2007/0231718 A1 Oct. 4, 2007

Related U.S. Application Data

(62) Division of application No. 10/875,227, filed on Jun. 25, 2004, now Pat. No. 7,241,546.

(30) Foreign Application Priority Data

Jul. 29, 2003 (JP) ..... 2003-203039

(51) Int. Cl.
*G03G 15/01* (2006.01)

(52) U.S. Cl. ..... 430/45.54; 430/124.1

(58) Field of Classification Search ..... 430/45.54, 430/124.1

See application file for complete search history.

(56) References Cited

U.S. PATENT DOCUMENTS

| | | | | |
|---|---|---|---|---|
| 5,797,070 | A | 8/1998 | Waki et al. | 399/149 |
| 6,002,903 | A | 12/1999 | Hayase et al. | 399/279 |
| 6,300,024 | B1 | 10/2001 | Yusa et al. | 430/45 |
| 6,458,502 | B1 | 10/2002 | Nakamura et al. | 430/137.17 |
| 6,544,708 | B2 | 4/2003 | Komoto et al. | 430/124 |
| 2002/0048713 | A1 | 4/2002 | Komoto et al. | 430/124 |
| 2003/0162118 | A1 | 8/2003 | Komatsu et al. | 430/124 |

FOREIGN PATENT DOCUMENTS

| | | |
|---|---|---|
| EP | 1 065 569 A2 | 1/2001 |
| EP | 1 143 303 A2 | 10/2001 |
| JP | 54-80752 | 6/1979 |
| JP | 06-59502 | 3/1994 |
| JP | 09-31499 | 12/1997 |

*Primary Examiner*—John L Goodrow
(74) *Attorney, Agent, or Firm*—Fitzpatrick, Cella, Harper & Scinto

(57) ABSTRACT

A toner includes toner particles containing at least a binder resin and a colorant, and inorganic fine particles. The shape factor SF-1 of the toner particles is in a specific range. The toner has a storage elastic modulus at 140° C., G' (140° C.), in a specific range the toner comes to have a viscosity of $1.0\times10^{3}$ Pa·s according to a flow tester heating method at a temperature of from 115° C. or more to less than 130° C.

11 Claims, 8 Drawing Sheets

TONER, AND IMAGE FORMING METHOD

This application claims priority from Japanese Patent Application No. 2003-203039 filed on Jul. 29, 2003, which is hereby incorporated by reference.

BACKGROUND OF THE INVENTION

1. Field of the Invention

This invention relates to a toner and an image forming method which are used in recording methods utilizing electrophotography or electrostatic recording. More particularly, this invention relates to a toner and an image forming method which are used in image forming apparatus such as copying machines, printers and facsimile machines in which a toner image is formed on an electrostatic latent image bearing member, thereafter the toner image is transferred to a transfer material via, or not via, an intermediate transfer member, and the toner image on the transfer material is fixed by heat and pressure.

2. Related Background Art

In printers or facsimile machines making use of electrophotography, in order to minituarize image forming apparatus or to simplify maintenance work, it has been spreaded that a developing assembly unit and a photosensitive drum unit are made into a unit or are integrally held together into a process cartridge.

As a developing system used in such a process cartridge, it is usual to use a one-component developing system as being advantageous to minituarization of the apparatus. In the one-component developing system, a one-component developer (hereinafter also referred to as "toner") is used, where the toner is provided with electric charges (charged electrostatically) by the friction between a toner layer control member (hereinafter also referred to as "control blade") and the toner or by the friction between a developer carrying member (hereinafter also referred to as "developing roller") and the toner, and at the same time thinly applied on the developing roller, and this toner is transported to a developing zone where the developing roller and the electrostatic latent image bearing member are opposed to each other, and develops the electrostatic latent image held on the electrostatic latent image bearing member as a toner image.

This one-component developing system, differently from a two-component developing system which requires carrier particles such as iron powder or ferrite powder, requires no carrier particles and hence can minituarize the developing assembly and reduce the weight. Moreover, since the toner concentration in a two-component developer must be kept at a stated value, the two-component developing system requires a device which detects toner concentration and feeds the toner to the developing assembly, causing the developing assembly to be larger and heavier. On the other hand, the one-component developing system does not require such a device. In this regard, the one-component developing system is advantageous to miniaturization and weight reduction of the apparatus. Further, non-magnetic toners are commonly used as a magenta toner, a yellow toner and a cyan toner which are used for full-color image formation.

Printers and copying machines are also demanded to be apparatus adapted to high-speed printing and copying. To satisfy such demand, it is a subject to be studied how to increase the process speed, and it is important to match a fixing assembly with a toner in that process.

In addition, it is preferable to restrain power consumption and improve usability such as quick-start performance.

In such a fixing process, a fixing assembly of a film heating system has been proposed having a small heat capacity.

In the fixing assembly of a film heating system, a heat-resistant film (fixing film) is held between a ceramic heater as a heating element and a pressure roller as a pressure member to form a nip, and a transfer material or recording material on which an unfixed toner image to be imagewise fixed is kept held is guided between the film and the pressure roller at the nip and is sandwiched and transported along with the film, whereby the heat of the ceramic heater is imparted to the transfer material or recording material at the nip via the film and further the unfixed toner image is fixed to the transfer material surface or recording material surface by heat and pressure by the aid of the pressure applied at the nip.

As features of this fixing assembly of a film heating system, an on-demand type assembly can be set up by using low-heat-capacity members as the ceramic heater and the film, and the ceramic heater as a heat source may be electrified only when the image forming apparatus performs image formation, bringing it into the state of heat generation at a stated fixing temperature. Thus, there are advantages that wait time can be shortened ranging from switching on an electric-source of the image forming apparatus until bringing the apparatus into a state that image formation can be started (quick-start performance), and that the power consumption at stand-by time can be vastly reduced (power saving).

However, such a fixing assembly may be insufficient in respect of the amount of heat as a fixing assembly used in full-color image forming apparatus or high-speed machines which are required to have a large amount of heat, and may cause problems of faulty fixing and gloss non-uniformity of fixed images.

As methods for restraining such phenomena, proposed are, as disclosed in Japanese Patent Applications Laid-open No. H9-311499 and No. H6-59502, a method in which the viscoelasticity of toner is specified, a method in which the flow tester viscosity of toner is specified, and a method in which both of these physical properties are specified. It, however, has turned out that at a certain fixing speed these toners have an insufficient effect of restraining faulty images.

SUMMARY OF THE INVENTION

An object of the present invention is to provide a toner that can effectively restrain faulty images even in high-speed printing or copying, and an image forming method making use of the toner.

Another object of the present invention is to provide a toner that can provide fixed images free of gloss non-uniformity and has superior low-temperature fixing performance, storage stability and many-sheet running (extensive operation) performance, and an image forming method making use of the toner.

A still another object of the present invention is to provide a cyan toner, a magenta toner, a yellow toner and a black toner that are able to form good full-color images, and also provide a full-color image forming method making use of these toners of respective colors.

To achieve the above objects, the present invention provides a toner having at least toner particles containing at least a binder resin and a colorant, and inorganic fine particles, wherein;

the toner particles have a shape factor SF-1 of from 100 or more to less than 130;

the toner has a storage elastic modulus at 140° C., G' (140° C.), of from $2.0\times10^3$ dN/m$^2$ or more to less than $2.0\times10^4$ dN/m$^2$; and the toner comes to have a viscosity of $1.0\times10^3$ Pa·s according to the flow tester heating method at a temperature of from 115° C. or more to less than 130° C.

The present invention also provides an image forming method having at least:

a charging step of externally applying a voltage to a charging member to charge an electrostatic latent image bearing member;

a latent image formation step of forming an electrostatic latent image on the electrostatic latent image bearing member thus charged;

a developing step of bringing a toner layer formed of a toner held on the surface of a toner carrying member into contact with the surface of the electrostatic latent image bearing member to develop the electrostatic latent image with the toner to form a toner image on the electrostatic latent image bearing member;

a transfer step of transferring the toner image to a transfer material via, or not via, an intermediate transfer member; and a fixing step of fixing the toner image held on the transfer material;

in the fixing step, any point on the transfer material taking 1/24 seconds to 1/8 seconds to pass through a fixing nip; and the toner having at least toner particles containing at least a binder resin and a colorant, and inorganic fine particles;

wherein;

the toner particles have a shape factor SF-1 of from 100 or more to less than 130;

the toner has a shape factor SF-1 of from 100 or more to less than 130;

the toner has a storage elastic modulus at 140° C., G' (140° C.), of from $2.0\times10^3$ dN/m$^2$ or more to less than $2.0\times10^4$ dN/m$^2$; and the toner comes to have a viscosity of $1.0\times10^3$ Pa·s according to the flow tester heating method at a temperature of from 115° C. or more to less than 130° C.

DESCRIPTION OF THE PREFERRED EMBODIMENTS

Figure 1:
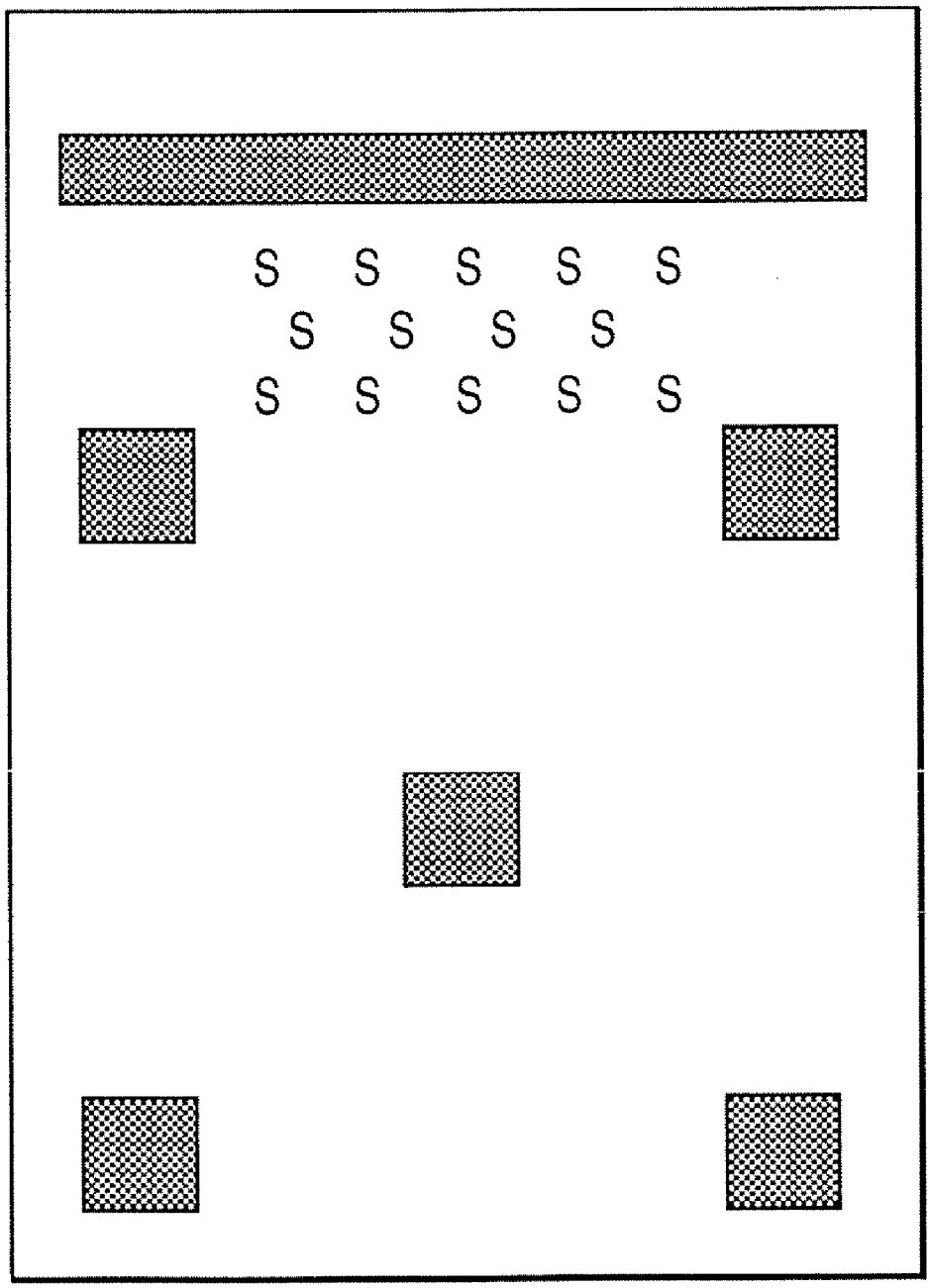
FIG. 1 diagrammatically illustrates an evaluation image used in evaluation in the present invention.

The present inventors have made detailed studies using image forming apparatus having a fixing assembly of a film heating system. As a result, they have found that the above faulty images such as gloss non-uniformity and offset tend to occur in a certain range of process speed regardless of pressure at the fixing nip. This phenomenon occurs especially when cardboard (with a basis weight of 105 g/m$^2$ or more) is used as a transfer material.

As a result of extensive studies, the present inventors have discovered that such faulty images can effectively be restrained even at the time of high-speed printing or copying, by the use of a toner having at least toner particles containing at least a binder resin and a colorant, and inorganic fine particles, which toner has a shape factor SF-1 of from 100 or more to less than 130, has a storage elastic modulus at 140° C., G' (140° C.), of from $2.0\times10^3$ dN/m$^2$ or more to less than $2.0\times10^4$ dN/m$^2$, and comes to have a viscosity of $1.0\times10^3$ Pa·s according to the flow tester heating method at a temperature of from 115° C. or more to less than 130° C.

As a means by which the fixing performance of the toner is known, a method is available which makes use of, e.g., a strain control type rheometer such as AREA (manufacture by Rheometric Scientific F.E. Ltd.). A method is also available which makes use of a fluidity characteristics evaluation device such as a flow tester CFT-500D (manufacture by Shimadzu Corporation, where temperature is changed (usually, raised) under application of a constant load to a sample to know a softening temperature, efflux start temperature and viscosity of the sample.

Here, it is considered that the value obtained by the rheometer corresponds to thermal characteristics of the binder resin in the toner, and the value obtained by the flow tester corresponds to thermal characteristics as the whole toner, inclusive of those which have been influenced by a release agent and a colorant.

The toner of the present invention has a storage elastic modulus at 140° C., G' (140° C.), of from $2.0\times10^3$ dN/m$^2$ or more to less than $2.0\times10^4$ dN/m$^2$, and preferably from $2.0\times10^3$ dN/m$^2$ or more to less than $1.0\times10^4$ dN/m$^2$, where the toner can have preferable thermal characteristics of the binder resin in the toner. Stated more specifically, a toner having superior anti-offset properties and fixed-image gloss uniformity can be obtained by setting the storage elastic modulus at 140° C., G' (140° C.), to from $2.0\times10^3$ dN/m$^2$ or more to less than $2.0\times10^4$ dN/m$^2$, and preferably from $2.0\times10^3$ dN/m$^2$ or more to less than $1.0\times10^4$ dN/m$^2$.

If the toner has a storage elastic modulus at 140° C., G' (140° C.), of less than $2.0\times10^3$ dN/m$^2$, it may have poor anti-offset properties, undesirably. If on the other hand the toner has a storage elastic modulus at 140° C., G' (140° C.), of $2.0\times10^4$ dN/m$^2$ or more, it may have poor fixed-image gloss uniformity (have gloss non-uniformity), undesirably. This phenomenon may occur remarkably when cardboard (with a basis weight of 105 g/m$^2$ or more) is used as a transfer material.

In the present invention, the storage elastic modulus at 140° C., G' (140° C.), is determined by the following method.

As a measuring instrument, AREA (manufacture by Rheometric Scientific F.E. Ltd.) is used, for example. Storage elastic modulus G' in the temperature range of from 60° C. to 200° C. is measured under the following conditions.

Measuring jig: A circular parallel plate of 8 mm in diameter is used. A shallow cup corresponding to the circular parallel plate is used on a actuator side. The gap between the shallow cup and the circular parallel plate is about 2 mm.

Measuring sample: The toner is so pressure-molded as to be a disk-like sample of about 8 mm in diameter and about 2 mm in height, and then used.

Measurement frequency: 6.28 radian/second.

Setting of measurement strain: The initial value is set to 0.1%, and thereafter measurement is made in an automatic measuring mode.

Correction of elongation of sample: Adjustment is made in an automatic measuring mode.

Measurement temperature: Raised to from 60° C. to 200° C. at a rate of 2° C. per minute.

The storage elastic modulus G' in the temperature range of from 60° C. to 200° C. is measured by the above method, and the value of storage elastic modulus G' at 140° C. is represented by G' (140° C.)

Meanwhile, the toner of the present invention is so made as to come to have a viscosity of $1.0\times10^3$ Pa·s according to the flow tester heating method at a measurement temperature of from 115° C. or more to less than 130° C., and preferably from 115° C. or more to less than 125° C., where the toner can have preferable thermal characteristics as the whole toner, inclusive of those which have been influenced by a release agent and a colorant. Stated more specifically, a toner superior in storage stability, running stability and fixed-image rub resistance can be obtained when having a viscosity of $1.0\times10^3$ Pa·s according to the flow tester heating method at a measurement temperature of from 115° C. or more to less than 130° C., and preferably from 115° C. or more to less than 125° C.

If the toner comes to have the viscosity of $1.0\times10^3$ Pa·s according to the flow tester heating method at a measurement temperature of less than 115° C., although preferable images having superior image glossiness can be obtained in the initial images, the toner may have poor storage stability and running performance. Stated specifically, such a toner is undesirable because inorganic fine particles added as an external additive may be buried in the surfaces of toner particles or the toner particles may transform to be non-uniform in triboelectric charge characteristics, and hence a phenomenon in which the toner adheres to non-image areas on the transfer material (hereinafter referred to as "fog") tends to occur.

If on the other hand toner comes to have the viscosity of $1.0\times10^3$ Pa·s at a measurement temperature of 130° C. or more, the toner particles cannot sufficiently transform in the fixing step in high-speed printing or copying to have images inferior in the effect of anchoring to the transfer material. Stated specifically, such a toner is undesirable because it tends to cause peeling of toner images when the surfaces of fixed images are rubbed.

The value of the viscosity of toner according to the flow tester heating method is determined by the following method.

| | |
|---|---|
| Sample: | About 1.1 g of the toner is weighed, and this is molded by pressure molding to prepare a sample. |
| Die orifice diameter: | 0.5 mm. |
| Die length: | 1.0 mm. |
| Cylinder pressure: | $9.807\times10^5$ (Pa). |
| Measuring mode: | Heating method. |
| Heating rate: | 4.0° C./min. |

The viscosity of toner at 50° C. to 200° C. is measured by the above method, and the measurement temperature at which the viscosity comes to be $1.0\times10^3$ Pa·s is determined.

In the present invention, the toner also has a shape factor SF-1 of from 100 or more to less than 130, and preferably from 100 or more to less than 125. The value of the shape factor SF-1 can be understood to be an index that correlates with thermal conductivity into toner images in the heat-and-pressure fixing step when all-solid images are fixed. The closer the toner particles are to sphericity, the smaller the spaces between toner particles are in the fixed image and the more readily the heat can be uniformly conducted through the whole toner. On the other hand, when the shape of toner particles are transformed, the spaces between toner particles in the fixed image become non-uniform, so that heat is conducted through the toner in a non-uniform manner to tend to cause faulty fixing. Stated specifically, this tends to cause peeling of toner images when the surfaces of fixed images are rubbed.

An influence the toner shape has on the fixed images appears more remarkably when the film fixing assembly (fixing assembly of a film heating system) is used as the fixing assembly. This is considered to be due to the fact that the film fixing assembly has heating members with a smaller heat capacity than a heat roll fixing assembly.

The shape factor SF-1 is calculated from the arithmetic mean of values obtained by sampling at random 100 images from images of toners by the use of FE-SEM (S-800), a field-emission scanning electron microscope manufactured by Hitachi Ltd., introducing information on them in an image analyzer (LUZEX-III; manufactured by Nireco Co.) through an interface to carry out analysis, and calculating the data according to the following expression.

$$\text{SF-1}\ ((\text{MXLNG})^2/\text{AREA})\times(\pi/4)\times100$$

(MXLNG: absolute maximum length of a particle; and AREA: projected area of a particle).

To obtain a toner in which the G' (140° C.) referred to in the present invention is favorable, a method is available in which the molecular weight distribution of the binder resin is controlled. Particularly effective is a method in which the peak top molecular weight (Mp) in measurement by gel permeation chromatography (GPC) is controlled. Stated specifically, a method is available in which the polymerization temperature in synthesizing the binder resin is controlled or the type of a polymerization initiator and the quantity of the polymerization initiator are controlled.

The G' (140° C.) of the toner may also be controlled to the stated value by adding a cross-linking component in an appropriate quantity when the binder resin is synthesized.

As a method for obtaining a toner in which the viscosity of toner according to the flow tester heating method has the stated value, in addition to the method in which the molecular weight distribution of the binder resin is made favorable, a method is available in which the amount of a release agent (wax) added and the degree of dispersion of the release agent in the binder resin are controlled. It is also preferable to additionally provide the surface layers of toner particles with outermost shell layers for the purpose of controlling the thermal conductivity to the toner. Where a method for obtaining the toner particles by polymerization in an aqueous dispersion medium is used, the outermost shell layers of toner particles can readily be provided by utilizing the polarity difference between the binder resin and the aqueous dispersion medium.

As a method for obtaining the toner having the stated shape factor SF-1, a method is available in which toner particles obtained by pulverization are made spherical by heat treatment. A preferable method for obtaining the toner having the stated shape factor SF-1 is a method in which toner particles are formed in an aqueous medium through a granulation step. The most preferable method therefor is a method in which toner particles are obtained by suspension polymerization or emulsion agglomeration in an aqueous dispersion medium.

In the toner of the present invention, where its wettability to a methanol/water mixed solvent is measured as transmittance of 780 nm wavelength light, the methanol concentration at the time the transmittance is 50% may preferably be within the range of from 30% to 60% by volume. The wettability of toner to a methanol/water mixed solvent can be used as an index to know the durability (running performance) of toner. The reason therefor is unclear, and is presumed to be due to a composite factor of the quantity in which the release agent (wax) exude from toner particles to their surface layer portions, the amount of inorganic fine particles used as an external additive and the hydrophilicity of the toner particles and inorganic fine particles.

In the case where the toner particles are formed by polymerization, it is also preferable that, after the step of polymerizing a polymerizable monomer, the reaction system is rapidly cooled to control the quantity of the release agent which is present on the toner particle surfaces.

If in the toner the methanol concentration at the time the transmittance is 50% is less than 30% by volume, the toner is an easily wettable toner on the toner particle surface layers of which a hydrophilic substance is present in a large quantity, and is easily influenced by the water content in the air, and hence the gloss uniformity of fixed images tends to lower. This phenomenon is remarkable especially when cardboard is used as a transfer material.

On the other hand, if in the toner the methanol concentration at the time the transmittance is 50% is more than 60% by volume, the toner is a sparingly wettable toner and is superior in fixed-image gloss uniformity. However, this is a case in which the release agent (wax) on the surfaces of toner particles is in an excessive quantity, or the inorganic fine particles used are not appropriate, or the amount of the inorganic fine particles used is not appropriate, tending to lower the storage stability of the toner and the uniformity of fixed images.

As a method for determining the methanol concentration concerned with the wettability to a methanol/water mixed solvent, the following method may be used.

For example, a powder wettability tester WET-100P, manufactured by Rhesca Company, Limited, is used as a measuring instrument, and measurement is made at room temperature (25° C.). First, 70 ml of a water-containing ethanol solution composed of 25% by volume of guaranteed methanol and 75% by volume of ion-exchanged water is put into a container. A specimen toner of 0.1 g precisely weighed is gently added thereto on the liquid surface of the water-containing ethanol solution to prepare a sample fluid used for the measurement of hydrophobic properties of the toner. At this point, the toner is kept to float on the liquid surface of the water-containing ethanol solution by surface tension. Next, this sample fluid for measurement is uniformly stirred with a stirrer at the number of revolutions of about 300 rpm, during which guaranteed ethanol is continuously added at a dropping rate of 0.8 ml/min., where light of 780 nm in wavelength is applied from the side of the measuring container to measure the transmittance. A nozzle for dropping the guaranteed ethanol is kept inserted into the sample fluid to prevent the scattering of measurement that may be caused by liquid splash.

In this measuring method, the time taken until the transmittance for the light of 780 nm in wavelength comes to 50% with respect to that at the start of measurement is determined, and the methanol concentration with respect to the ion-exchanged water at that point is calculated.

As for a toner for which the measurement is not completed within the preset time in the above method, numerical values are obtained by repeating the measurement after the concentration of the water-containing ethanol solution has been appropriately adjusted.

The measurement of molecular weight distribution by GPC of the toner and binder resin is carried out by the following method.

To prepare a sample, the toner or binder resin is dissolved in tetrahydrofuran (THF) at room temperature in such a way that the resin component in the sample is 0.4 to 0.6 mg/ml, and the solution obtained is filtered with a solvent-resistant membrane filter of 0.2 μm in pore diameter.

Next, columns are stabilized in a 40° C. heat chamber, and THF (tetrahydrofuran) as a solvent is flowed therethrough at a flow rate of 1 ml per minute. About 100 μl of a THF sample solution is injected thereinto, conducting measurement. In measuring the molecular weight of the sample, the molecular weight distribution of the sample is calculated from the relationship between the logarithmic value of a calibration curve prepared using several kinds of monodisperse polystyrene standard samples and the number of counts. As the standard polystyrene samples used for the preparation of the calibration curve, TSK Standard Polystyrene F-850, F-450, F-288, F-128 F-80, F-40, F-20, F-10, F-4, F-2, F-1, A-5000, A-2500, A-1000 and A-500, available from Tosoh Corporation, are used. Also, as detectors, an RI (refractive index) detector and a UV (ultraviolet) detector are used which are arranged in series. As columns, it is desirable to use a plurality of commercially available polystyrene gel columns in combination. In the present invention, measurement is carried out using a combination of Shodex GPC KF-801, KF-802, KF-803, KF-804, KF-805, KF-806 and KF-807, available from Showa Denko K.K.

As a measuring instrument, a high-speed GPC, HPLC8120 GPC (manufactured by Tosoh Corporation) is used, for example.

Average particle diameter of the toner may be measured with, e.g., a measuring instrument making use of Coulter Counter Model TA-II or Coulter Multisizer (manufactured by Coulter Electronics, Inc.), to which an interface (manufactured by Nikkaki K.K.) that outputs number distribution and volume distribution and a personal computer are connected. In this measurement, an electrolytic solution is used. As this electrolytic solution, a 1% NaCl aqueous solution prepared using first-grade sodium chloride, or ISOTON R-II (available from Coulter Scientific Japan Co.) may be used.

Measurement is carried out by adding as a dispersant 0.1 to 5 ml of a surface active agent (preferably an alkylbenzenesulfonate) to 100 to 150 ml of the above aqueous electrolytic solution, and further adding 2 to 20 mg of a measuring sample. The electrolytic solution in which the sample has been suspended is subjected to dispersion for about 1 minute to about 3 minutes in an ultrasonic dispersion machine. The volume distribution is calculated by measuring the volume of toner particles with particle diameters of 2 μm or more by means of the above Coulter Counter Model TA-II, using an aperture of 100 μm. Then, the weight-average particle diameter is determined.

In the production of the toner particles according to the present invention, the polymerizable monomer may include the following.

The polymerizable monomer may include styrene; styrene derivatives such as o-methylstyrene, m-methylstyrene, p-methylstyrene, p-methoxystyrene and p-ethylstyrene; acrylic esters such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate and phenyl acrylate; methacrylic esters such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; and acrylonitrile, methacrylonitrile and acrylamides.

Any of these monomers may be used alone or in combination. Of the foregoing monomers, a copolymer of a monomer selected from styrene and a styrene derivative with a monomer selected from an acrylate and a methacrylate (hereinafter referred to as "stylene-acrylate copolymer") may be used as a chief component of the binder resin. This is preferable in view of developing performance and running performance of the toner. Stated specifically, the styrene-acrylate copolymer may account for 50% by weight or more, and preferably 80% by weight or more, of the binder resin components, whereby a toner can be obtained having less variation in developing performance even when used over a long period of time and superior running performance.

In the production of toner particles by polymerization, the polymerization may be carried out by adding the resin to a polymerizable monomer composition. For example, a polymerizable monomer unit containing a hydrophilic functional group such as an amino group, a carboxylic group, a hydroxyl group, a sulfonic acid group, a glycidyl group or a nitrile group cannot be used as a polymerizable monomer because it is water-soluble and dissolves in an aqueous suspension to cause emulsion polymerization. When such a monomer unit should be introduced into toner particles, it may be added to a polymerizable monomer composition in the form of a copolymer such as a random copolymer, a block copolymer or a graft copolymer, of any of these with a vinyl type polymerizable monomer such as styrene or ethylene so as to be used in polymerization in an aqueous medium. Alternatively, it may also be used in the form of a polycondensation product such as polyester resin or polyamide resin, or in the form of a polyaddition polymer such as polyether or polyimine.

In the case where a high polymer containing such a polar functional group is used, one having an average molecular weight of 5,000 or more may be preferable. If the high polymer containing a polar functional group has a number-average molecular weight of less than 5,000, especially 4,000 or less, the high polymer is liable to concentrate in the vicinity of the surfaces of toner particles, tending to lower developing performance and anti-blocking properties, undesirably. Also, as the high polymer containing a polar functional group, polyester resin is particularly preferred.

For the purpose of improving dispersibility of materials, fixing performance or image properties, a resin other than the foregoing may also be added to the polymerizable monomer composition. Such a resin may include, e.g., polystyrene; homopolymers of styrene derivatives such as polyvinyl toluene; styrene copolymers such as a styrene-propylene copolymer, a styrene-vinyltoluene copolymer, a styrene-vinylnaphthalene copolymer, a styrene-methyl acrylate copolymer, a styrene-ethyl acrylate copolymer, a styrene-butyl acrylate copolymer, a styrene-octyl acrylate copolymer, a styrene-dimethylaminoethyl acrylate copolymer, a styrene-methyl methacrylate copolymer, a styrene-ethyl methacrylate copolymer, a styrene-butyl methacrylate copolymer, a styrene-dimethylaminoethyl methacrylate copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer, a styrene-maleic acid copolymer and a styrene-maleate copolymer; and polymethyl methacrylate, polybutyl methacrylate, polyvinyl acetate, polyethylene, polypropylene, polyvinyl butyral, silicone resins, polyester resins, polyamide resins, epoxy resins, polyacrylic acid resins, rosins, modified rosins, terpene resins, phenolic resins, aliphatic or alicyclic hydrocarbon resins, and aromatic petroleum resins. Any of these polymers, copolymers and resins may be used alone or in the form of a mixture.

Any of these polymers, copolymers and/or resins may preferably be added in an amount of from 1 to 20 parts by weight based on 100 parts by weight of the polymerizable monomer. With the amount of less than 1 part by weight, the effect of the addition is not sufficiently exhibited, and with the amount of more than 20 part by weight, various physical properties of synthetic magnetic toner particles is difficult to design.

In addition, when dissolving in the polymerizable monomer composition a polymer, a copolymer and/or a resin having molecular weight distribution different from the molecular weight distribution of the toner particles obtained by polymerizing the polymerizable monomer and polymerizing the polymerizable monomer, a toner having broad molecular weight distribution and high anti-offset properties can be produced.

The toner of the present invention may preferably have a glass transition temperature (Tg) ranging from 40° C. to 70° C., and more preferably from 45° C. to 65° C. If the has a glass transition temperature of less than 40° C., the toner is low in storage stability and running stability. If the toner has the Tg of more than 70° C., it is high in fixing temperature. Especially in the case of color toners for forming full-color images, the color mixing performance at the time of fixing toners of respective colors may be lowerd, resulting in a low color reproducibility.

The Tg of the toner is measured in the following way.

The Tg is determined from a DSC curve formed when a sample (toner) is heated for the second time after being heated and cooled once, where the temperature at the point at which the middle line between the base line before the appearance of the endothermic peak and the base line after the appearance of the endothermic peak intersects with the rising curve is regarded as Tg.

The toner of the present invention contains a colorant for providing coloring power. The toner of the present invention is used as a cyan toner, a magenta toner, a yellow toner and/or a black toner. Four-color toners, a cyan toner, a magenta toner, a yellow toner and a black toner, are at least used in the full-color image forming method. As organic pigments or organic dyes preferably used in the present invention, they may include the following.

Organic pigments or organic dyes usable as cyan colorants may include copper phthalocyanine compounds and derivatives thereof, anthraquinone compounds, basic dye lake compounds and so forth. Stated specifically, they may include C.I. Pigment Blue 1, C.I. Pigment Blue 7, C.I. Pigment Blue 15, C.I. Pigment Blue 15:1, C.I. Pigment Blue 15:2, C.I. Pigment Blue 15:3, C.I. Pigment Blue 15:4, C.I. Pigment Blue 60, C.I. Pigment Blue 62 and C.I. Pigment Blue 66.

Organic pigments or organic dyes usable as magenta colorants may include condensation azo compounds, diketopyrrolopyrrole compounds, anthraquinone compounds, quinacridone compounds, basic-dye lake compounds, naphthol compounds, benzimidazolone compounds, thioindigo compounds and perylene compounds. Stated specifically, they may include C.I. Pigment Red 2, C.I. Pigment Red 3, C.I. Pigment Red 5, C.I. Pigment Red 6, C.I. Pigment Red 7, C.I. Pigment Red 19, C.I. Pigment Red 23, C.I. Pigment Red 48:2, C.I. Pigment Red 48:3, C.I. Pigment Red 48:4, C.I. Pigment Red 57:1, C.I. Pigment Red 81:1, C.I. Pigment Red 122, C.I. Pigment Red 144, C.I. Pigment Red 146, C.I. Pigment Red 166, C.I. Pigment Red 169, C.I. Pigment Red 177, C.I. Pigment Red 184, C.I. Pigment Red 185, C.I. Pigment Red 202, C.I. Pigment Red 206, C.I. Pigment Red 220, C.I. Pigment Red 221 and C.I. Pigment Red 254.

Organic pigments or organic dyes usable as yellow colorants may include condensation azo compounds, isoindolinone compounds, anthraquinone compounds, azo metal complexes, methine compounds and allylamide compounds. Stated specifically, they may include C.I. Pigment Yellow 12, C.I. Pigment Yellow 13, C.I. Pigment Yellow 14, C.I. Pigment Yellow 15, C.I. Pigment Yellow 17, C.I. Pigment Yellow 62, C.I. Pigment Yellow 74, C.I. Pigment Yellow 83, C.I. Pigment Yellow 93, C.I. Pigment Yellow 94, C.I. Pigment Yellow 95, C.I. Pigment Yellow 97, C.I. Pigment Yellow 109, C.I. Pigment Yellow 110, C.I. Pigment Yellow 111, C.I. Pigment Yellow 120, C.I. Pigment Yellow 127, C.I. Pigment Yellow 128, C.I. Pigment Yellow 129, C.I. Pigment Yellow 147, C.I. Pigment Yellow 151, C.I. Pigment Yellow 154, C.I. Pigment Yellow 168, C.I. Pigment Yellow 174, C.I. Pigment Yellow 175, C.I. Pigment Yellow 176, C.I. Pigment Yellow 180, C.I. Pigment Yellow 181, C.I. Pigment Yellow 191 and C.I. Pigment Yellow 194.

Any of these colorants may be used alone, in the form of a mixture, or in the state of a solid solution. The colorants used for the toner of the present invention are selected taking account of hue, chroma, brightness, light-fastness, transparency of OHP films and dispersibility in toner particles.

The colorant may be used in its addition of an amount of from 1 to 20 parts by weight based on 100 parts by weight of the binder resin.

As black colorants, carbon black and colorants toned to black by the use of yellow, magenta and cyan colorants shown above may be used. In the present invention, it is preferable to use carbon black.

In the case where color toners are produced, the colorants may preferably be selected from disazo type yellow pigments, quinacridone type magenta pigments and phthalocyanine type cyan pigments.

In the toner of the present invention, it is preferable to use a release agent for attaining releasability at the time of fixing. As the release agent, preferred is the use of a wax whose maximum endothermic peak temperature (mp) in the DSC endothermic curve is in the region of from 55° C. to 120° C., and preferably from 60° C. to 110° C. If the maximum endothermic peak temperature of the toner is in the region of less than 55° C., its developing performance tends to lower. If on the other hand the maximum endothermic peak temperature of the toner is in the region of more than 120° C., the solubility of the toner in the polymerizable monomer composition may be lowered, so that the release agent may be deposited while granulating the polymerizable monomer composition in an aqueous medium into droplets each of which has a size corresponding to the toner particle diameter, and the granulation is difficult to carry out.

The release agent usable for the toner of the present invention may include petroleum waxes and derivatives thereof such as paraffin wax, microcrystalline wax and petrolatum; montan wax and derivatives thereof; hydrocarbon waxes obtained by Fischer-Tropsch synthesis, and derivatives thereof; polyethylene wax and derivatives thereof; and naturally occurring waxes such as carnauba wax and candelilla wax, and derivatives thereof. The derivatives include oxides, block copolymers with vinyl monomers, and graft modified products.

Preferable release agents usable in the present invention may include ester waxes belonging to compounds represented by the following Formulas (I) to (V).

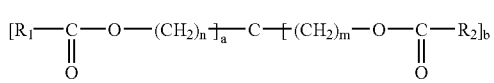

(I)

wherein a and b are each an integer of 0 to 4, provided that a+b is 4; $R_1$ and $R_2$ are each an organic group having 1 to 40 carbon atoms; and m and n are each an integer of 0 to 40, provided that m and n are not 0 at the same time.

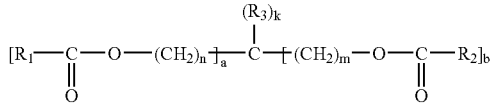

(II)

wherein a and b are each an integer of 0 to 3, provided that a+b is 1 to 3; $R_1$ and $R_2$ are each an organic group having 1 to 40 carbon atoms; $R_3$ is a hydrogen atom or an organic group having 1 or more carbon atoms; k is an integer of 1 to 3 and a+b+k=4; and m and n are each an integer of 0 to 40, provided that m and n are not 0 at the same time.

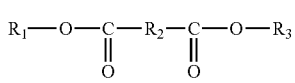

(III)

wherein $R_1$ and $R_3$ are each an organic group having 1 to 40 carbon atoms, and $R_1$ and $R_3$ may be the same or different; and $R_2$ represents an organic group having 1 to 40 carbon atoms.

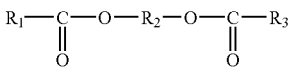

(IV)

wherein $R_1$ and $R_3$ are each an organic group having 1 to 40 carbon atoms, and $R_1$ and $R_3$ may be the same or different; and $R_2$ represents an organic group having 1 to 40 carbon atoms.

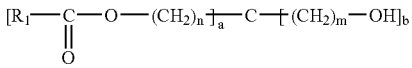

(V)

wherein a is an integer of 0 to 4 and b is an integer of 1 to 4, provided that a+b is 4; $R_1$ is an organic group having 1 to 40 carbon atoms; and m and n are each an integer of 0 to 40, provided that m and n are not 0 at the same time.

More preferable examples may include the following compounds.

$$CH_3(CH_2)_{20}COO(CH_2)_{21}CH_3 \quad (1)$$

$$CH_3(CH_2)_{17}COO(CH_2)_9OOC(CH_2)_{17}CH_3 \quad (2)$$

$$CH_3(CH_2)_{17}COO(CH_2)_{18}COO(CH_2)_{17}CH_3 \quad (3)$$

In the case when the toner particles are produced by polymerization, the wax may be used in an amount of from 5 to 25 parts by weight, and preferably from 7 to 20 parts by weight, based on 100 parts by weight of the polymerizable monomer, and the wax may be contained in the resultant toner particles in an amount of from 5 to 25 parts by weight based on 100 parts by weight of the binder resin. Such a toner is preferable in order to perform oilless fixing.

In the case where the toner particles are produced by pulverization, the wax may be used in an amount of from 5 to 15 parts by weight based on 100 parts by weight of the binder resin. This is preferable in order to perform oilless fixing.

In the case where the toner particles are produced by polymerization, the polymerizable monomer composition may be polymerized for several hours at a temperature higher by 1° C. to 10° C. (preferably 1° C. to 6° C.) than the half-life temperature of a polymerization initiator used, and thereafter the polymerization temperature may further be raised. This is preferable because a toner having the stated viscoelasticity is readily obtainable. As a preferable polymerization initiator, one having a half-life of from 0.5 hour to 30 hours at the time of polymerization reaction is preferable. The polymerization initiator may preferably be used in an amount of from 0.5 to 20 parts by weight based on 100 parts by weight of the polymerizable monomer.

The polymerization initiator may include azo type or diazo type polymerization initiators such as 2,2'-azobis-2-methylbutyronitrile, 2,2'-azobis-(2,4-dimethylvaleronitrile), 2,2'-azobisisobutyronitrile, 1,1'-azobis-(cyclohexane-1-carbonitrile) and 2,2'-azobis-4-methoxy-2,4-dimethylvaleronitrile; and peroxide type polymerization initiators such as benzoyl peroxide, methyl ethyl ketone peroxide, diisopropyl peroxycarbonate, cumene hydroperoxide, 2,4-dichlorobenzoyl peroxide, lauroyl peroxide, t-butyl peroxy-2-ethylhexanoate.

A cross-linking agent may also be added to the polymerizable monomer composition. It may preferably be used in an amount of from 0.001 to 15% by weight based on 100 parts by weight of the polymerizable monomer.

As the cross-linking agent, compounds having at least two polymerizable double bonds may be used. It may include, e.g., aromatic divinyl compounds such as divinyl benzene and divinyl naphthalene; carboxylic esters having two double bonds, such as ethylene glycol diacrylate, ethylene glycol dimethacrylate and 1,3-butanediol dimethacrylate; divinyl compounds such as divinyl aniline, divinyl ether, divinyl sulfide and divinyl sulfone; and compounds having at least three vinyl groups. Any of these cross-linking agents may be used alone or in the form of a mixture.

In the case where the toner particles are produced by polymerization, a polymerizable monomer composition is prepared by appropriately adding to the polymerizable monomer components necessary as toner particles, such as a colorant, a release agent, a plasticizer, a charge control agent and/or a cross-linking agent, and dissolving or dispersing these uniformly by means of a dispersion machine such as a homogenizer, a ball mill, a colloid mill or an ultrasonic dispersion machine, and is suspended in an aqueous medium containing a dispersion stabilizer. Here, a high-speed dispersion machine such as a high-speed stirrer or an ultrasonic dispersion machine may be used in order for the toner particles to have the desired particle size at a stretch, thereby enabling the resultant toner particles to have a sharp particle size distribution. The polymerization initiator may be added simultaneously when other additives are added to the polymerizable monomer, or may be added immediately before the polymerizable monomer composition is suspended in the aqueous medium. Also, a polymerization initiator having been dissolved in the polymerizable monomer or in a solvent may be added immediately after granulation and before the polymerization reaction is initiated.

After the granulation, agitation may be carried out using a usual agitator in such an extent that the state of particles is maintained and also the particles can be prevented from floating and settling.

In the case where the toner is produced by polymerization, known surface-active agents or organic or inorganic dispersants may be used as dispersion stabilizers. In particular, the inorganic dispersants may hardly cause ultrafine powder and they attain dispersion stability on account of their steric hindrance. Hence, even when reaction temperature is changed, they hardly break the stability, can be washed with ease and may hardly adversely affect toners, and hence they may preferably be used. Examples of such inorganic dispersants include phosphoric acid polyvalent metal salts such as calcium phosphate, magnesium phosphate, aluminum phosphate and zinc phosphate; carbonates such as calcium carbonate and magnesium carbonate; inorganic salts such as calcium metasilicate, calcium sulfate and barium sulfate; and inorganic oxides such as calcium hydroxide, magnesium hydroxide, aluminum hydroxide, silica, bentonite and alumina.

Any of these inorganic dispersants may preferably be used in an amount of from 0.2 to 20 parts by weight based on 100 parts by weight of the polymerizable monomer. It may optionally be used in combination with a surface-active agent used in an amount of from 0.001 to 0.1 part by weight based on 100 parts by weight of the polymerizable monomer.

Such a surface-active agent may include, e.g., sodium dodecylbenzenesulfate, sodium tetradecyl sulfate, sodium pentadecyl sulfate, sodium octyl sulfate, sodium oleate, sodium laurate, sodium stearate and potassium stearate.

When these inorganic dispersants are used, they may be used as they are. In order to obtain finer particles, particles of the inorganic dispersant may be formed in the aqueous medium. For example, in the case of calcium phosphate, an aqueous sodium phosphate solution and an aqueous calcium chloride solution may be mixed under high-speed agitation, whereby water-insoluble calcium phosphate can be formed and more uniform and finer dispersion can be made. Then, water-soluble sodium chloride is simultaneously formed as a by-product. However, when such a water-soluble salt is present in the aqueous medium, the polymerizable monomer is inhibited from dissolving in water and ultrafine toner particles formed by emulsion polymerization is hard to produce, and hence, this situation is more favorable. Since the presence of the water-soluble salt may be an obstacle when residual polymerizable monomers are removed at the termination of polymerization reaction, it is better to exchange the aqueous medium for a new one or desalt it with an ion-exchange resin. The inorganic dispersant can substantially completely be removed by dissolving it with an acid or an alkali after the polymerization is completed.

In the polymerization step, the polymerization may be carried out at a polymerization temperature set at 40° C. or above, and commonly at a temperature of from 50° C. to 90° C. When polymerization is carried out within this temperature range, the release agent (wax) enclosed inside the toner particles is deposited by phase separation to come to be enclosed more perfectly. In order to consume residual polymerizable monomers, the reaction temperature may be raised to 90° C. to 150° C. at the termination of polymerization reaction.

After the polymerization is completed, the resulting toner particles may be filtered, washed and dried by known methods, and inorganic fine particles may be mixed to adhere to the toner particle surfaces, thus the toner can be obtained. The step of classification may also be added to the production process to remove any coarse powder and fine powder.

In the case where the toner is produced by pulverization, any known methods may be used. For example, the binder resin, the colorant, the release agent, a charge control agent and so forth are thoroughly mixed by mean of a mixer such as a Henschel mixer or a ball mill, then the mixture obtained is melt-kneaded by means of a heat kneading machine such as a heat roll, a kneader or an extruder to compatibilize the resin and so on with one another, into which other toner materials are dispersed or dissolved. The resultant kneaded product is cooled to solidify, followed by pulverization, thereafter classification and optionally surface treatment to produce toner particles. Either of the classification and the surface treatment may be carried out first. In the step of classification, a multi-division classifier may preferably be used in view of production efficiency.

The pulverization step may be carried out by any methods making use of a known pulverizer such as a mechanical impact type pulverizer or a jet type pulverizer.

The toner particles according to the present invention may still also be produced by the method as disclosed in Japanese Patent Publication No. S56-13945, in which a molten mixture is atomized in the air by means of a disk or a multiple fluid nozzle to obtain spherical toner particles; a dispersion polymerization method in which toner particles are directly produced using an aqueous organic solvent capable of dissolving polymerizable monomers and not capable of dissolving the resultant polymer; a soap-free polymerization method in which toner particles are produced by direct polymerization in the presence of a water-soluble polar polymerization initiator; and an emulsion agglomeration method in which resin particles obtained by emulsion polymerization are agglomerated to produce toner particles.

The toner of the present invention may also be mixed with a charge control agent in order to stabilize charge characteristics. As the charge control agent, any known agents may be used. In the case where the toner particles are directly produced by polymerization, particularly preferred are charge control agents low in polymerization inhibitory action and substantially free of solubilizate into the aqueous dispersion medium.

As negative charge control agents, they may include metal compounds of aromatic carboxylic acids such as salicylic acid, alkylsalicylic acids, dialkylsalicylic acids, naphthoic acid and dicarboxylic acid; metal salts or metal complexes of azo dyes or azo pigments; polymer type compounds having a sulfonic acid or carboxylic acid group in the side chain; as well as boron compounds, urea compounds, silicon compounds, and carixarene.

As positive charge control agents, they may include quaternary ammonium salts, polymer type compounds having such a quaternary ammonium salt in the side chain, guanidine compounds, Nigrosine compounds and imidazole compounds.

The charge control agent may preferably be used in an amount of from 0.5 to 10 parts by weight based on 100 parts by weight of the polymerizable monomer or based on 100 parts by weight of the binder resin.

In the present invention, the inorganic fine particles are optionally externally added to the toner particle surfaces as an external additive.

In order to improve charge stability, developing performance, fluidity and storage stability of the toner, the inorganic fine particles may preferably be selected from fine particles of silica, alumina and titania or double oxides thereof.

For the purpose of making hydrophobic and/or controlling chargeability, it is preferable for the inorganic fine particles used in the present invention to have been treated with a treating agent such as a silicone varnish, various types of modified silicone varnish, a silicone oil, a modified silicone oil, a silane coupling agent, a silane coupling agent having a functional group, or an organic titanium compound.

A method using an apparatus such as a Henschel mixer may be used for adding the inorganic fine particles externally to the toner particles.

The image forming method of the present invention and the image forming apparatus and process cartridge practicing the method are described below with reference to the accompanying drawings.

The toner of the present invention may preferably be used in an image forming method having:

(1) a first charging step of externally applying a voltage to a charging member to charge a first electrostatic latent image bearing member;

a first latent image formation step of forming a first electrostatic latent image on the first electrostatic latent image bearing member thus charged;

a first developing step of bringing a toner layer formed of a first toner held on the surface of a first toner carrying member into contact with the surface of the first electrostatic latent image bearing member to develop the first electrostatic latent image with the first toner to form a first toner image on the first electrostatic latent image bearing member; and a first transfer step of transferring the first toner image to a transfer material via, or not via, an intermediate transfer member;

the first toner being selected from the group consisting of a cyan toner, a magenta toner, a yellow toner and a black toner;

(2) a second charging step of externally applying a voltage to a second charging member to charge a second electrostatic latent image bearing member;

a second latent image formation step of forming a second electrostatic latent image on the second electrostatic latent image bearing member thus charged;

a second developing step of bringing a toner layer formed of a second toner held on the surface of a second toner carrying member into contact with the surface of the second electrostatic latent image bearing member to develop the second electrostatic latent image with the second toner to form a second toner image on the second electrostatic latent image bearing member; and a second transfer step of transferring the second toner image to the transfer material via, or not via, the intermediate transfer member;

the second toner being selected from the group consisting of a cyan toner, a magenta toner, a yellow toner and a black toner, and being different from the first toner;

(3) a third charging step of externally applying a voltage to a third charging member to charge a third electrostatic latent image bearing member;

a third latent image formation step of forming a third electrostatic latent image on the third electrostatic latent image bearing member thus charged;

a third developing step of bringing a toner layer formed of a third toner held on the surface of a third toner carrying member into contact with the surface of the third electrostatic latent image bearing member to develop the third electrostatic latent image with the third toner to form a third toner image on the third electrostatic latent image bearing member; and a third transfer step of transferring the third toner image to the transfer material via, or not via, the intermediate transfer member;

the third toner being selected from the group consisting of a cyan toner, a magenta toner, a yellow toner and a black toner, and being different from the first toner and the second toner;

(4) a fourth charging step of externally applying a voltage to a fourth charging member to charge a fourth electrostatic latent image bearing member;

a fourth latent image formation step of forming a fourth electrostatic latent image on the fourth electrostatic latent image bearing member thus charged;

a fourth developing step of bringing a toner layer formed of a fourth toner held on the surface of a fourth toner carrying member into contact with the surface of the fourth electrostatic latent image bearing member to develop the fourth electrostatic latent image with the fourth toner to form a fourth toner image on the fourth electrostatic latent image bearing member; and a fourth transfer step of transferring the fourth toner image to the transfer material via, or not via, the intermediate transfer member;

the fourth toner being selected from the group consisting of a cyan toner, a magenta toner, a yellow toner and a black toner, and being different from the first toner, the second toner and the third toner;

(5) a heat-and-pressure fixing step of fixing the first toner image, the second toner image, the third toner image and the fourth toner image which are held on the transfer material, to form a full-color image;

in the fixing step, time taken for any point on the transfer material to pass through a fixing nip being from 1/24 seconds to 1/8 seconds; and each of the first, second, third and fourth toners comprising toner particles containing at least a binder resin and a colorant, and inorganic fine particles;

wherein;

said toner particles have a shape factor SF-1 of from 100 or more to less than 130;

each of the first, second, third and fourth toners has a storage elastic modulus at 140° C., G' (140° C.), of from $2.0\times10^3$ dN/m$^2$ or more to less than $2.0\times10^4$ dN/m$^2$; and each of the first, second, third and fourth toners comes to have a viscosity of $1.0\times10^3$ Pa·s according to the flow tester heating method at a temperature of from 115° C. or more to less than 130° C.

The respective-color toners of the present invention have the specific viscoelasticity, and hence have superior fixing performance, high-temperature anti-offset properties and color mixing performance. Hence, where the respective-color toners of the present invention are used, the oilless fixing is possible, the fixing speed can be made higher, and the full-color images obtained have uniform glossiness and superior rub resistance.

A developing assembly having a toner layer control member and a contact developing method are described with reference to FIG. 2.

Figure 2:
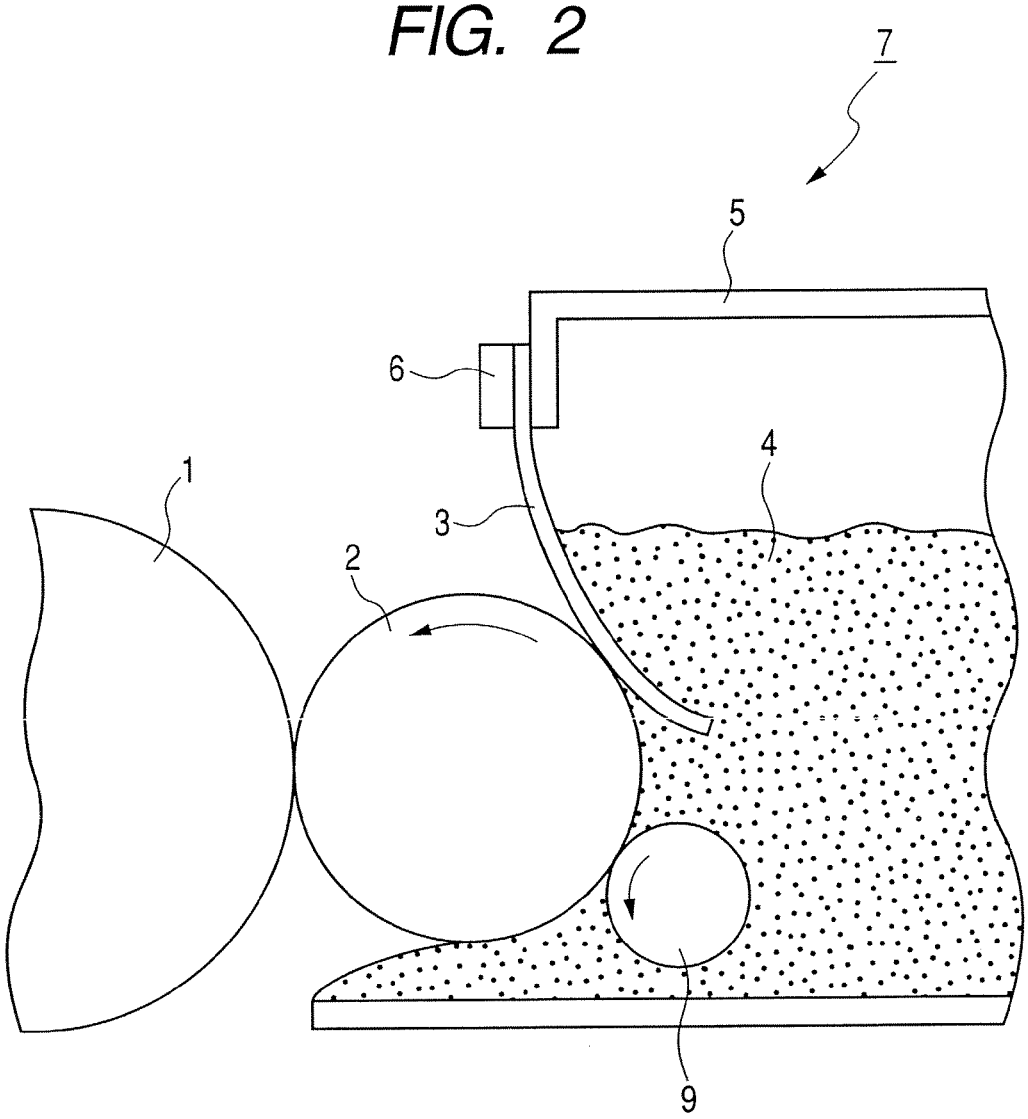
FIG. 2 schematically illustrates a toner layer thickness control member in the image forming method of the present invention.

FIG. 2 shows part of a photosensitive drum 1 and part of a developing assembly 7. The developing assembly 7 has a toner container 5 which holds therein a non-magnetic toner 4 as a one-component developer. A developing roller 2 as a toner carrying member disposed facing the electrostatic latent image bearing member photosensitive drum 1 is rotatably disposed at an opening extending in the lengthwise direction inside the toner container 5. Also, the developing roller 2 is laterally provided in such a way that it is thrust into the toner container 5 by the right half of its peripheral surface as viewed in FIG. 2 and is exposed to the outside of the toner container 5 by the left half of its peripheral surface.

A control blade 3 as the toner layer control member is so provided as to be supported by a holder sheet metal 6 at the upper position of the developing roller 2. The control blade 3 is, in the vicinity of its free end side, kept in touch with the peripheral surface of the developing roller 2 in the state of face-to-face touch. The direction in which the control blade 3 is kept in touch with the developing roller 2 is the counter (opposite) direction where the end side of the control blade 3 is positioned on the upstream side in the rotational direction of the developing roller 2 with respect to the touch portion.

As the developing roller 2, an elastic roller 2 is used, and the elastic roller 2 is coated with the toner to form a toner layer. The elastic roller 2 stands pressed against the surface of the photosensitive drum 1 in such a way that the surface of the photosensitive drum 1 and the toner layer come into contact with each other.

In this case, the electric field acting between the photosensitive drum 1 and the elastic roller 2 facing the photosensitive member surface through the toner is utilized to develop the electrostatic latent image. In order to develop the electrostatic latent image with the toner, it is necessary for the elastic roller 2 surface or the vicinity of the surface to have a potential so that an electric field is formed at a narrow gap between the photosensitive drum 1 surface and the elastic roller 2 surface. Accordingly, a method may also be used in which the elastic rubber of the elastic roller 2 is controlled to have a resistance in the medium-resistance region to keep the electric field while preventing electric contact with the photosensitive drum 1 surface, or a thin-layer insulating layer is provided on the surface layer of the elastic roller (conductive layer) 2. It is also possible to make up a conductive resin sleeve 2 comprising a conductive roller 2 covered with an insulating material on its side facing the photosensitive drum 1 surface, or an insulating sleeve 2 provided with a conductive layer on its side not facing the photosensitive drum 1 surface. It is still also possible to make up a rigid-material roller used as the toner carrying member 2 and a flexible member such as a belt used as the photosensitive drum 1. The roller as the toner carrying member 2 may preferably have a volume resistivity in the range of from $10^2$ to $10^9$ Ω·cm.

As the surface profile of the toner carrying member 2, its surface roughness Ra (μm) may be so set as to be from 0.2 to 3.0. This enables both high image quality and high running performance to be achieved. The surface roughness Ra correlates with toner transportability and toner chargeability. If the toner carrying member 2 has a surface roughness Ra of more than 3.0, the toner layer on the toner carrying member 2 is difficult to thin and also the performance of providing the toner with triboelectric charges may lower, and the image quality tends to lower. By setting the surface roughness Ra (μm) to be 0.2 to 3.0, the toner transportability of the toner carrying member 2 surface can be controlled, and the toner layer on the toner carrying member 2 can be thinned, and also the number of times the toner carrying member comes into contact with the toner can be increased. Hence, the performance of providing the toner with triboelectric charges can also be improved to cooperatively improve image quality. On the other hand, if the toner carrying member has a surface roughness Ra smaller than 0.2, it is difficult to control the toner coat level.

In the present invention, the surface roughness Ra of the toner carrying member 2 corresponds to the centerline average roughness measured with a surface roughness measuring device (SURFCORDER SE-30H, manufactured by Kosaka Laboratory Ltd.) according to JIS surface roughness "JIS B 0601 (2001)." Stated specifically, a portion of 2.5 mm is drawn out of the roughness curve, setting a measurement length a in the centerline direction. When the centerline of this drawn-out portion is represented by X axis, the direction of lengthwise magnification by Y axis, and the roughness curve by y=f(x), the value determined according to the following expression and indicated in micrometer (μm) is referred to as the surface roughness Ra.

$$Ra = 1/a \int_0^a |f(x)|\, dx$$

In the image forming method of the present invention, the toner carrying member 2 may be rotated in the same direction as, or the reverse direction to, the photosensitive member. When the two are rotated in the same direction, the peripheral speed of the toner carrying member 2 may be set to be 1.05 to 3.0 times the peripheral speed of the photosensitive drum 1.

If the peripheral speed of the toner carrying member 2 is less than 1.05 times the peripheral speed of the photosensitive drum 1, the agitation effect the toner on the photosensitive drum 1 undergoes may lower, so that it is difficult to obtain good image quality. If on the other hand their peripheral speed ratio is more than 3.0, deterioration in toner due to mechanical stress or sticking of toner to the toner carrying member 2 tends to occur, undesirably.

As the photosensitive drum 1, preferably used is a photosensitive drum or photosensitive belt having a photoconductive insulating material layer formed of OPC (organic photoconductor) or a-Si (amorphous silicon). The photosensitive drum 1 may be a photosensitive belt. Also, the binder resin of an organic photosensitive layer of the OPC photosensitive member may include, but is not limited to, polycarbonate resins, polyester resins and acrylic resins, which are particularly preferred because they ensure superior transfer performance and hardly cause melt adhesion of toner and filming of external additives to the photosensitive member.

The image forming method of the present invention is described below with reference to the accompanying drawings.

Figure 3:
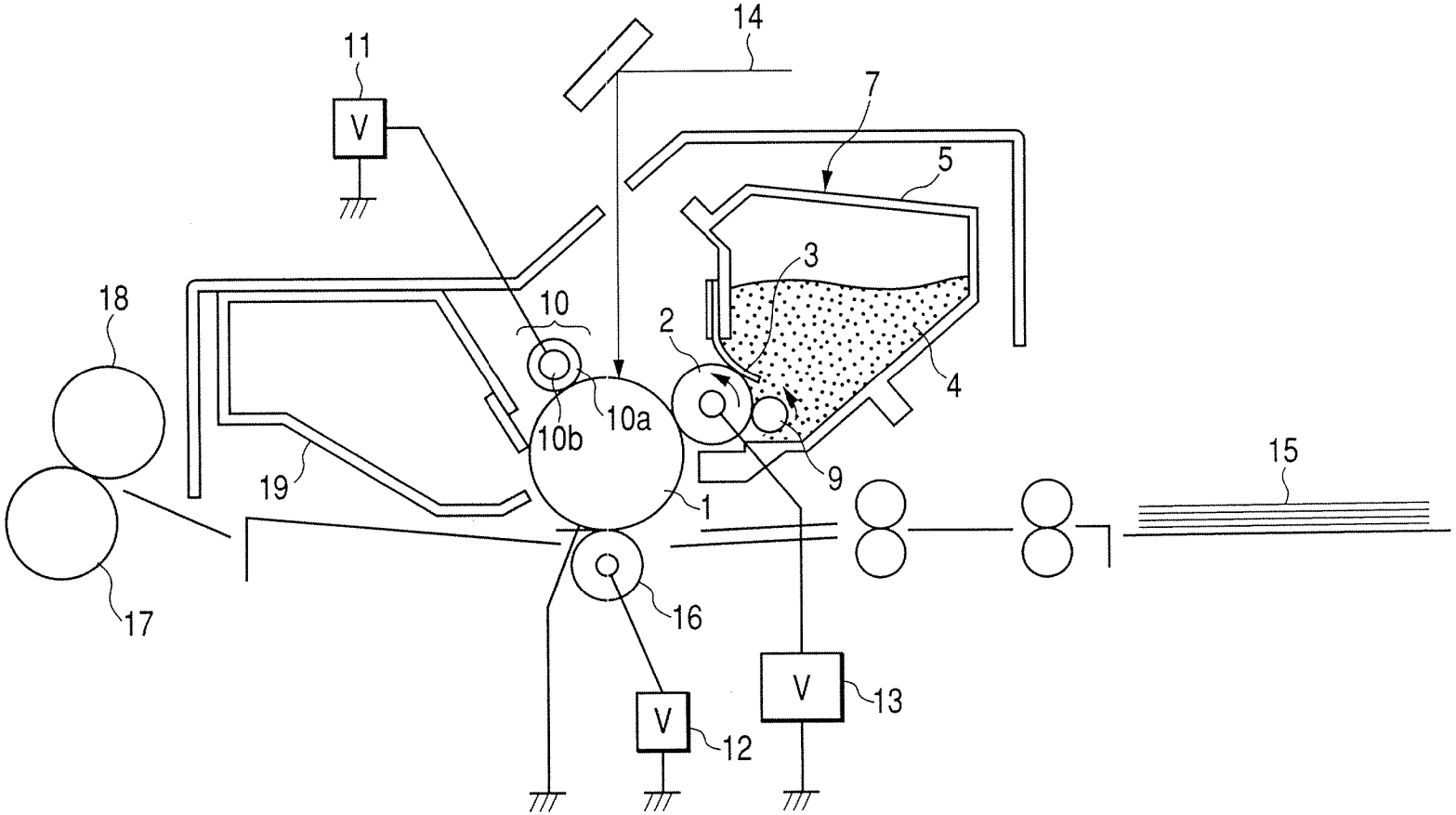
FIG. 3 schematically illustrates the constitution of an example of an apparatus practicing the image forming method of the present invention.

FIG. 3 schematically illustrates the constitution of an example of an image forming apparatus having a process cartridge and a developing assembly, which practices the image forming method of the present invention. As shown in FIG. 3, the image forming apparatus has a charging roller 10 as a primary charging member which directly charges a photosensitive drum 1 in contact with it, bias power sources 11 to 13, transfer materials 15 such as sheets of paper, a transfer roller 16, a fixing pressure roller 17, a fixing heating roller 18, and a cleaner 19. In FIG. 3, the same members as those shown in FIG. 2 are denoted by the same reference numerals.

To the charging roller 10, the bias power source 11 is connected so that the surface of the photosensitive drum 1 is uniformly charged. The developing assembly 7 holds a toner 4 in a toner container 5, and has a developing roller 2 which is a toner carrying member rotated in the direction of an arrow. It also has a control blade 3 which is a toner layer control member for controlling the toner coat level and charging the toner, and a coating roller 9 which is rotated in the direction of an arrow in order to attach the toner 4 to the developing roller 2 and also to provide the toner with triboelectric charges by friction with the developing roller 2. To the developing roller 2, a development bias power source 13 is connected. A bias power source (not shown) is also connected to the coating roller 9, where a voltage is set on the negative side with respect to the development bias when a negatively chargeable toner is used and on the positive side with respect to the development bias when a positively chargeable toner is used.

Where an electrostatic latent image is developed by the reverse development system to form a toner image, a power source 12 for transfer bias with a polarity reverse to that of the photosensitive drum 1 is connected to the transfer roller 16.

As the developing roller 2, an elastic roller may preferably be used, which has an elastic layer at the surface. As materials for the elastic layer used in the elastic roller, those having a hardness of from 30 to 60 degrees (Asker-C/load 1 kg)) may preferably be used.

The toner coat level is controlled by the control blade 3. The control blade 3 stands pressed against the developing roller 2 through the toner layer. Here, the pressing force of the control blade 3 against the developing roller 2 may preferably be in the range of from 0.05 N/cm to 0.50 N/cm as linear pressure in the generatrix direction of the developing roller 2.

The linear pressure refers to the load applied to the control blade 3 per unit length. For example, when a load of 1.2 N is applied to a blade 3 having a touch length of 1 m and this blade is brought into contact with the developing roller 2, the linear pressure is 1.2 N/m. If the linear pressure is less than 0.05 N/cm, it may be difficult not only to control the toner coat level but also to perform uniform triboelectric charging, tending to cause fog. If on the other hand the linear pressure is more than 0.50 N/cm, the toner may undergo an excess load, tending to cause the deformation of toner particles or the melt-adhesion of toner to the developing roller 2, undesirably.

In the free edge of the control blade 3, its section may be linear, and besides may be in an L-shape as bent in the vicinity of the edge, or may be in a shape spherically swollen in the vicinity of the edge, any of which may preferably be used.

As the control blade 3, an elastic member made of a metal such as stainless steel, copper or phosphor bronze may be used as its substrate, and a resin may be provided by bonding or coating at its part coming into touch with the touch portion of the developing roller 2. Such a blade may preferably be used.

A DC electric field and/or an AC electric field may also be applied to the control blade 3, whereby the uniform thin-layer coating performance and uniform charging performance can be further improved due to the loosening action acting on the toner, so that a high image density can be achieved and images with good quality can be formed.

In the apparatus shown in FIG. 3, the primary charging member 10 uniformly electrostatically charges the photosensitive drum 1 rotating in the direction of an arrow. In this example, the primary charging member 10 used is a charging roller 10 constituted basically of a mandrel 10*b* at the center and a conductive elastic layer 10*a* forming its periphery. The charging roller 10 is kept in pressure contact with part of the surface of the electrostatic latent image bearing member photosensitive drum 1 and is rotated following the rotation of the photosensitive drum 1.

As preferable process conditions when the charging roller 10 is used, the contact pressure of the charging roller 10 is 0.05 to 5 N/cm, and a bias generated from DC voltage alone or a bias generated by superimposing an AC voltage on a DC voltage is used as the applied voltage. Though not particularly limited, when the bias generated by superimposing an AC voltage on a DC voltage is used, AC voltage is 0.5 to 5 dvpp, AC frequency is 50 Hz to 5 kHz, DC voltage is ±0.2 to ±1.5 kV. When the DC voltage is used, DC voltage is ±0.2 to ±5 kV. In the present invention, the applied voltage generated only from DC voltage may preferably be used.

As a charging means other than the charging roller 10, available are a method making use of a charging blade and a method making use of a conductive brush. These contact charging means have such effects that high voltage is unnecessary and ozone is reduced, as compared with non-contact corona charging. The charging roller and charging blade as contact charging means may preferably be made of a conductive rubber, and a release coat may be provided on its surface. The release coat may be formed of a nylon resin, PVDF (polyvinylidene fluoride) or PVDC (polyvinylidene chloride), any of which may be used.

Subsequently to the step of charging the photosensitive drum (electrostatic latent image bearing member) 1, an electrostatic latent image corresponding to information signals is formed on the photosensitive drum 1 by exposure 14 from a light-emitting device, and the electrostatic latent image is developed with the toner at the position coming into contact with the developing roller 2, forming a toner image. The image forming method of the present invention may be used especially in combination with a development system of forming a digital latent image on the photosensitive drum 1, thereby allowing development faithful to a dot latent image because the latent image is not disordered. Then, the toner image is transferred to the transfer material 15 by means of the transfer roller 16 to which a voltage is kept applied, then passes through a fixing nip formed between the heating roller 18 and the pressure roller 17, and is fixed by heat and pressure, obtaining a fixed image.

Meanwhile, transfer residual toner not transferred and having remained on the photosensitive drum 1 is collected by means of a cleaner having a cleaning blade kept in contact with the surface of the photosensitive drum 1. Thus, the photosensitive drum 1 is cleaned.

Figure 4:
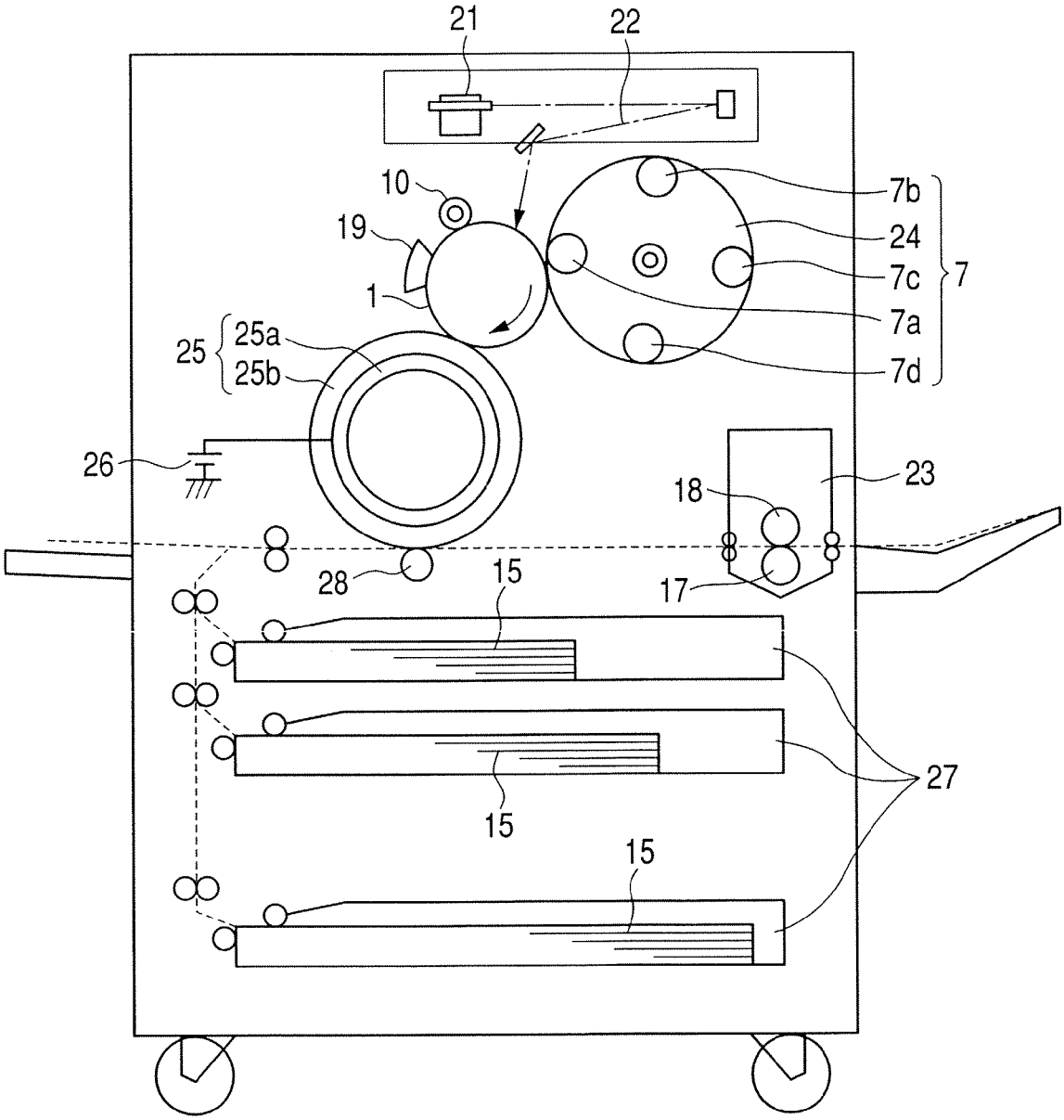
FIG. 4 schematically illustrates the constitution of another example of an apparatus practicing the image forming method of the present invention.

FIG. 4 schematically illustrates the constitution of an example of a full-color image forming apparatus in which a multiple toner image is one-time transferred to a transfer material 25 through an intermediate transfer member 25 and to which the image forming method of the present invention is applicable.

As shown in FIG. 4, the full-color image forming apparatus has developing assemblies 7*a* to 7*d* for respective colors of black, yellow, magenta and cyan, a light source assembly 21 emitting laser light 22, a heat-and-pressure fixing assembly 23, a developing unit 24 (having the developing assemblies 7*a* to 7*d*), an intermediate transfer drum 25 (having a conductive support 25*a* and an elastic layer 25*b*) as an intermediate transfer member, a bias power source 26, transfer material trays 27, and a secondary transfer assembly 28. In FIG. 4, the same members as those shown in FIGS. 2 and 3 are denoted by the same reference numerals.

A rotatable charging roller 10 as a charging member, to which a charging bias voltage is kept applied, is brought into contact with the surface of a photosensitive drum 1 as an electrostatic latent image bearing member while rotating the charging roller 10, to effect uniform primary charging of the photosensitive drum 1 surface. Then, a first electrostatic latent image is formed on the photosensitive drum 1 by exposure to the laser light 22 emitted from the light source assembly 21 as an exposure means. The first electrostatic latent image thus formed is developed with a black toner held in the black developing assembly 7*a* as a first developing assembly, to form a black toner image with the developing assembly 7*a* being provided in the rotatable developing unit 24. The black toner image formed on the photosensitive drum 1 is primarily electrostatically transferred onto the intermediate transfer drum 25 by the action of a transfer bias voltage applied to the conductive support 25*a* of the intermediate transfer drum 25.

Next, a second electrostatic latent image is formed on the surface of the photosensitive drum 1 in the same way as the above, and the developing unit 24 is rotated to develop the second electrostatic latent image with a yellow toner held in the yellow developing assembly 7*b* as a second developing assembly, to form a yellow toner image. The yellow toner image is primarily electrostatically transferred onto the intermediate transfer drum 25 on which the black toner image has primarily been transferred. Similarly, third and fourth electrostatic latent images are formed and, rotating the developing unit 24, they are sequentially developed with a magenta toner held in the magenta developing assembly 7*c* as a third developing assembly and a cyan toner held in the cyan developing assembly 7*d* as a fourth developing assembly, respectively, and the magenta toner image and cyan toner image formed are primarily transferred. Thus, the toner images of respective colors are primarily transferred onto the intermediate transfer drum 25.

These toner images primarily transferred as a multiple toner image (the black, yellow, magenta and cyan toner images) onto the intermediate transfer drum 25 are secondarily electrostatically one-time transferred onto a transfer material 15 by the action of a transfer bias voltage applied from a second transfer assembly 28 positioned on the opposite side via the transfer material 15. The multiple toner image secondarily transferred onto the transfer material 15 is fixed by heat and pressure to the transfer material 15 by means of a fixing assembly 23 having a heating member 17 and a pressure member 18. Thus, a full-color image is formed on the transfer material. Transfer residual toner remaining on the surface of the photosensitive drum 1 after transfer is collected by a cleaner 19 having a cleaning blade coming in contact with the surface of the photosensitive drum 1, thus the photosensitive drum is cleaned.

For the primary transfer from the photosensitive drum 1 to the intermediate transfer drum 25, a transfer electric current is formed by applying a bias from a bias power source 26 to a conductive support 25*a* of the intermediate transfer drum 25 serving as a first transfer means, thus the toner images can be transferred.

The intermediate transfer drum 25 comprises the conductive support 25*a* which is a rigid body and an elastic layer 25*b* which covers its surface. The conductive support 25*a* may be formed using a metal such as aluminum, iron, copper or stainless steel, or a conductive resin with conductive particles such as carbon or metal particles dispersed therein. As the shape of the intermediate transfer drum 25, it may be a cylinder, a cylinder through the center of which a shaft is passed, or a cylinder reinforced on its inside.

As a material constituting the elastic layer 25*b*, preferably usable are elastomer rubbers such as styrene-butadiene rubber, high styrene rubber, butadiene rubber, isoprene rubber, ethylene-propylene copolymer, nitrile butadiene rubber (NBR), chloroprene rubber, butyl rubber, silicone rubber, fluororubber, nitrile rubber, urethane rubber, acrylic rubber, epichlorohydrin rubber and norbornane rubber. Resins such as polyolefin resins, silicone resins, fluorine resins and polycarbonate resins, and copolymers or mixtures of any of these may also be used.

On the surface of the elastic layer 25*b*, a surface layer may further be formed in which a highly lubricating and water-repellent lubricant powder has been dispersed in any desired binder.

As the lubricant, preferably usable are various types of fluororubbers, fluoroelastomers, carbon fluorides comprising fluorine-bonded graphite, fluorine compounds such as polytetrafluoroethylene (PTFE), polyvinylidene fluoride (PVDF), ethylene-tetrafluoroethylene copolymer (ETFE) and tetrafluoroethylene-perfluoroalkyl vinyl ether copolymers (PFA), silicone compounds such as silicone resins, silicone rubbers and silicone elastomers, polyethylene (PE), polypropylene (PP), polystyrene (PS), acrylic resins, polyamide resins, phenol resins, and epoxy resins.

To the binder of the surface layer, a conducting agent may also be added appropriately in order to control its resistance. The conducting agent may include various types of conductive inorganic particles, carbon black, ionic conducting agents, conductive resins and conductive-particle-dispersed resins.

The multiple toner image on the intermediate transfer drum 25 is secondarily transferred collectively onto the transfer material 15 by means of the secondary transfer assembly 28. As the transfer assembly 28 usable is a non-contact electrostatic transfer means making use of a corona charging assembly, or a contact electrostatic transfer means making use of a transfer roller or a transfer belt.

In place of the intermediate transfer drum 25 used in the image forming apparatus shown in FIG. 4, an intermediate transfer belt may be used to collectively transfer the multiple toner image to the recording medium.

Figure 5:
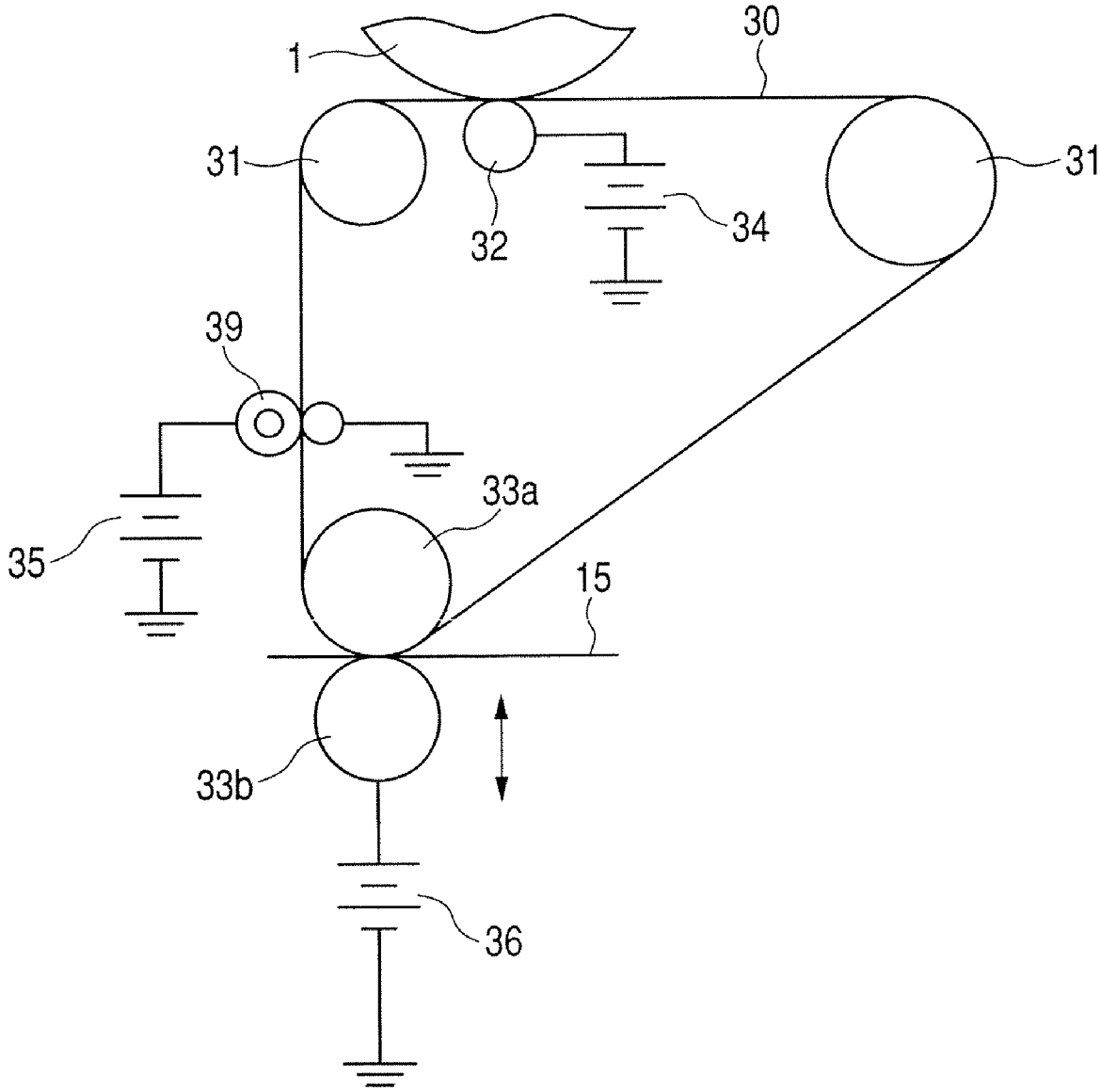
FIG. 5 schematically illustrates the constitution of still another example of an apparatus practicing the image forming method of the present invention.

FIG. 5 partially schematically illustrates the constitution of an image forming apparatus making use of such an intermediate transfer belt.

The apparatus shown in FIG. 5 has an intermediate transfer belt 30, rollers 31 which the intermediate transfer belt 30 is fitted over and around, a primary transfer roller 32, a secondary transfer opposing roller 33*a*, a secondary transfer roller 33*b*, bias power sources 34 to 36, and a cleaning charging member 39. In FIG. 5, the same members as those shown in FIGS. 2 to 4 are denoted by the same reference numerals.

In the constitution shown in FIG. 5, while the toner images formed and held on the photosensitive drum 1 pass a nip between the photosensitive drum 1 and the intermediate transfer belt 30, they are primarily transferred sequentially to the peripheral surface of the intermediate transfer belt 30 by the aid of an electric field formed by a primary transfer bias applied to the intermediate transfer belt 30 through a primary transfer roller 32.

The primary transfer bias for the sequential superimposing transfer of the first- to fourth-color toner images to the intermediate transfer belt 30 has a polarity opposite to that of the toner and is applied from the bias power source 34.

In the step of primarily transferring the first- to fourth-color toner images from the photosensitive drum 1 to the intermediate transfer belt 30, the secondary transfer roller 33*b* and the cleaning charging member 39 may be separated from the intermediate transfer belt 30.

The secondary transfer roller 33*b* is axially supported in parallel with the secondary transfer opposing roller 33*a* and is so provided as to be separable from the bottom part of the intermediate transfer belt 30.

To transfer to a transfer material 15 a synthesized full-color toner image (multiple toner image) transferred onto the intermediate transfer belt 30, the secondary transfer roller 33*b* is brought into contact with the intermediate transfer belt 30 and also the transfer material 15 is fed to the contact nip between the intermediate transfer belt 30 and the secondary transfer roller 33*b* at given timing, where a secondary transfer bias is applied from the bias power source 36 to the secondary transfer roller 33*b*. By the aid of this secondary transfer bias, the multiple toner image is secondarily transferred from the intermediate transfer belt 30 to the transfer material 15.

After the image transfer to the transfer material 15 is completed, the cleaning charging member 39 is brought into contact with the intermediate transfer belt 30, and a bias having a polarity opposite to that of the photosensitive drum 1 is applied from the bias power source 35, so that electric charges having a polarity opposite to that of the photosensitive drum 1 are imparted to the toner (transfer residual toner) remaining on the intermediate transfer belt 30 without being transferred to the transfer material 15. Then, the transfer residual toner is transferred to the photosensitive drum 1 at the nip between the intermediate transfer belt 30 and the photosensitive drum 1 and in the vicinity thereof, thus the intermediate transfer belt 30 is cleaned.

The intermediate transfer belt 30 includes a belt-like base layer and a surfacing layer provided on the base layer. The surfacing layer may be composed of a plurality of layers.

In the base layer and the surfacing layer, rubber, elastomer or resin may be used. For example, as the rubber and the elastbmer, usable are one or more materials selected from the group consisting of natural rubber, isoprene rubber, styrene-butadiene rubber, butadiene rubber, butyl rubber, ethylene-propylene rubber, ethylene-propylene copolymer, chloroprene rubber, chlorosulfonated polyethylene, chlorinated polyethylene, acrylonitrile butadiene rubber, urethane rubber, syndioctactic 1,2-polybutadiene, epichlorohydrin rubber, acrylic rubber, silicone rubber, fluororubber, polysulfide rubbers, polynorbornane rubber, hydrogenated nitrile rubbers, and thermoplastic elastomers (e.g., polystyrene type, polyolefin type, polyvinyl chloride type, polyurethane type, polyamide type, polyester type and fluorine resin type elastomers), but not limited to these materials. As the resin, resins such as polyolefin resins, silicone resins, fluorine resins and polycarbonate resins may be used. Copolymers or mixtures of any of these resins may also be used.

As the base layer, any of the above rubbers, elastomers and resins formed into films may be used. A core material layer may also be used having the form of woven fabric, nonwoven fabric, yarn or film on one side or both sides of which any of the above rubbers, elastomers and resins is coated, soaked or sprayed.

The material constituting the core material layer may include natural fibers such as cotton, silk, hemp and wool; regenerated fibers such as chitin fiber, alginic acid fiber and regenerated cellulose fiber; semisynthetic fibers such as acetate fiber; synthetic fibers such as polyester fiber, nylon fiber, acrylic fiber, polyolefin fiber, polyvinyl alcohol fiber, polyvinyl chloride fiber, polyvinylidene chloride fiber, polyurethane fiber, polyalkylparaoxybenzoate fiber, polyacetal fiber, aramid fiber, polyfluoroethylene fiber and phenol fiber; inorganic fibers such as carbon fiber, glass fiber and boron fiber; and metal fibers such as iron fiber and copper fiber. One or more materials selected from these may be used.

A conducting agent may further be added to the base layer and surfacing layer in order to control the resistivity of the intermediate transfer belt 30. For example, usable are carbon powder, metal powders such as aluminum or nickel powder, metal oxides such as titanium oxide, and conductive polymeric compounds such as quaternary-ammonium-salt-containing polymethyl methacrylate, polyvinyl aniline, polyvinyl pyrrole, polydiacetylene, polyethyleneimine, boron-containing polymeric compounds, and polypyrrole. One or more conducting agents selected from the group consisting of these may be used.

A lubricant may also optionally be added in order to improve the lubricity of the intermediate transfer belt 30 to improve its transfer performance. The lubricant may include fluororubbers, fluoroelastomers, carbon fluorides comprising fluorine-bonded graphite, fluorine compounds such as polytetrafluoroethylene (PTFE), polyvinylidene fluoride (PVDF), ethylene-tetrafluoroethylene copolymer (ETFE) and tetrafluoroethylene-perfluoroalkyl vinyl ether copolymers (PFA), silicone compounds such as silicone resins, silicone rubbers and silicone elastomers, polyethylene (PE), polypropylene (PP), polystyrene (PS), acrylic resins, polyamide resins, phenol resins, and epoxy resins.

The constitution of a tandem type full-color image forming apparatus is described with reference to FIG. 6, wherein in apparatus the toner images of different colors are respectively formed in a plurality of image forming sections and they are sequentially transferred and superimposed onto the same transfer material.

Figure 6:
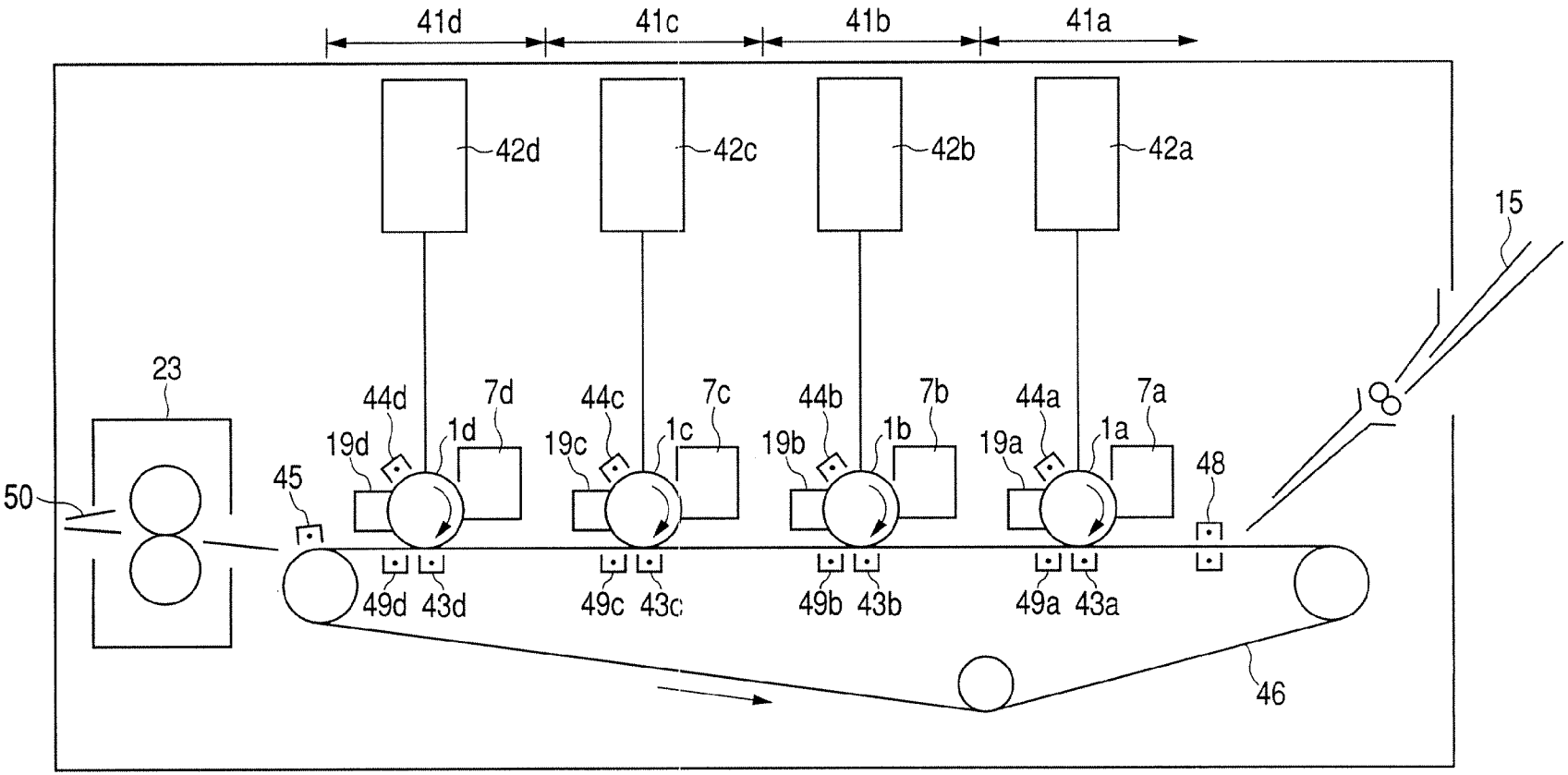
FIG. 6 schematically illustrates the constitution of a further example of an apparatus practicing the image forming method of the present invention.

As shown in FIG. 6, the full-color image forming apparatus has photosensitive drums 1*a* to 1*d*, cleaners 19*a* to 19*d*, image forming sections 41*a* to 41*d*, latent image forming means 42*a* to 42*d*, transferring discharge means 43*a* to 43*d*, primary charging means 44*a* to 44*d*, a charge eliminator 45, a transfer belt 46, developing assemblies 7*a* to 7*d*; an attraction charging assembly 48, separation destaticizing means 49*a* to 49*d*, and a heat-and-pressure fixing means 23. The heat-and-pressure fixing means 23 has a delivery opening 50. In FIG. 6, the same members as those shown in FIGS. 2 to 4 are denoted by the same reference numerals.

In the constitution shown in FIG. 6, the first to fourth image forming sections 41*a* to 41*d* are side by side provided, and the image forming sections have respectively electrostatic latent image bearing members exclusively used therefor, i.e., the photosensitive drums 1*a* to 1*d*. The photosensitive drums 1*a* to 1*d* are provided on their peripheral sides with the latent image forming means 42*a* to 42*d*, the developing assemblies 7*a* to 7*d*, the transfer discharging means 43*a* to 43*d*, the cleaners 19*a* to 19*d* and the primary charging means 44*a* to 44*d*, respectively.

With such constitution, on the photosensitive drum 1*a* of the first image forming section 41*a*, for example, a yellow component color electrostatic latent image is formed by the latent image forming means 42*a*. This electrostatic latent image is developed with a yellow toner of the developing assembly 7*a* to form a yellow toner image, and the yellow toner image is transferred to a transfer material 15 by means of the transferring discharge means 43*a*.

While the yellow toner image is transferred to the transfer material 15 as described above, in the second image forming section 41*b*, a magenta component color latent image is formed on the photosensitive drum 1*b*, and subsequently is developed with a magenta toner of the developing assembly 7*b* to form a magenta toner image. The magenta toner image is transferred and superimposed onto a preset position of the transfer material 15 when the transfer material 15 with the image transferred thereon in the first image forming section 41*a* is transported to the transferring discharge means 43*b*.

Subsequently, in the same manner as described above, cyan and black color toner images are formed in the third and fourth image forming sections 41*c* and 41*d*, respectively, and the cyan and black color toner images are sequentially transferred and superimposed onto the same transfer material 15 to form a multiple toner image. Upon completion of such an image forming process, the transfer material 15 is transported to the heat-and-pressure fixing means 23, where the multiple toner image on the transfer material 15 is fixed by heat and pressure. Thus, a multi-color image is obtained on the transfer material 15. The respective photosensitive drums la to 1*d* having completed the transfer are cleaned by the cleaners 19*a* to 19*d*, respectively, to remove the residual toner, and are used for the next electrostatic latent image formation subsequently carried out.

In the above full-color image forming apparatus, the transport belt 46 is used to transport the transfer material 15. As viewed in FIG. 6, the transfer material 15 is transported from the right side to the left side, and, in the course of this transport, passes through the transferring discharge means 43*a* to 43*d* in the image forming sections 41*a* to 41*d*, respectively, to undergo transfer.

In the above full-color image forming apparatus, as a transport means for transporting the transfer material 15, a transport belt making use of a mesh made of Tetoron fiber and a transport belt making use of a thin dielectric sheet made of a polyethylene terephthalate resin, a polyimide resin or a urethane resin are used from the viewpoint of easiness of working and durability.

After the transfer material 15 has passed through the fourth image forming section 41*d*, a DC voltage is applied to the charge eliminator 45, whereupon the transfer material 15 is decharged, separated from the transfer belt 46, then conveyed to the heat-and-pressure fixing means 23, where the multiple toner image is fixed by heat and pressure, and discharged through the delivery opening 50.

Such a full-color image forming apparatus is so made up that the four image forming sections have respectively independent electrostatic latent image bearing members and the transfer material 15 is conveyed successively to the transfer zones of the respective electrostatic latent image bearing members by a belt type transport means. Instead, the apparatus may also be so made up that it has an electrostatic latent image bearing member common to the respective image forming sections and the transfer material is conveyed repeatedly to the transfer zone of the electrostatic latent image bearing member by a drum type transport means so that the toner images of respective colors are received there.

In the transfer belt system shown in FIG. 6, since the transfer belt has a high volume resistivity, it continues increasing charge quantity while the transfer is repeated several times, as in the case of color image forming apparatus. Hence, uniform transfer cannot be maintained unless the transfer electric currents increase successively at every transfer. However, the toner of the present invention has so good a transfer performance that the transfer performance of the toner at every transfer can be uniformized under the like transfer electric currents even if the charge of the transfer belt has increased at every repeated transfer, and so, images with a good quality and a high quality level can be obtained.

Figure 7:
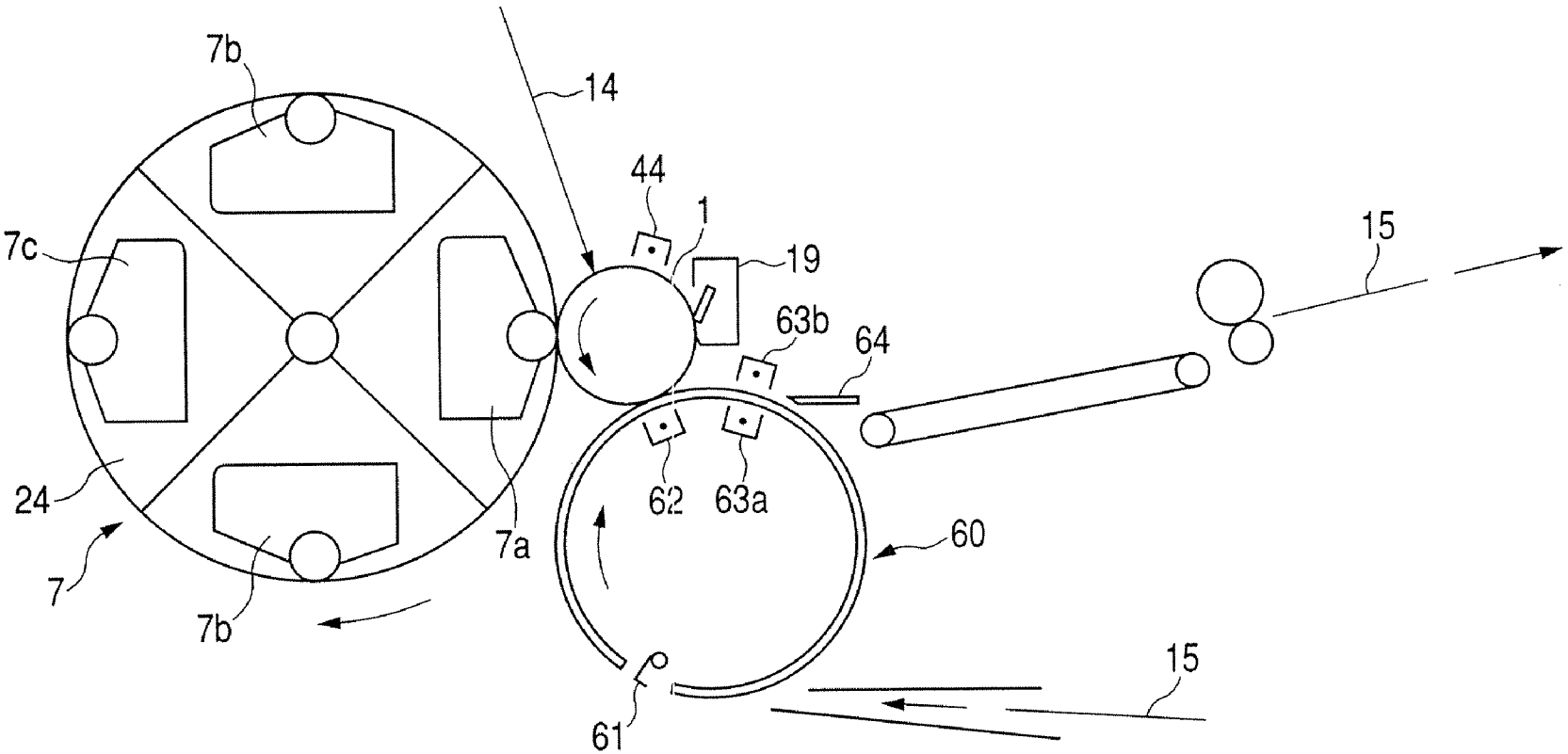
FIG. 7 schematically illustrates the constitution of a still further example of an apparatus practicing the image forming method of the present invention.

FIG. 7 further schematically illustrates the constitution of another full-color image forming apparatus practicing the image forming method of the present invention, which will be described below.

As shown in FIG. 7, the full-color image forming apparatus has a primary charging means 44, a transfer drum 60, a gripper 61, a transfer charging assembly 62, separation charging assemblies 63*a* and 63*b*, and a separation guide 64. In FIG. 7, the same members as those shown in FIGS. 2 to 6 are denoted by the same reference numerals.

In the constitution shown in FIG. 7, an electrostatic latent image formed on the photosensitive drum 1 through a suitable means is developed with a first toner to form a toner image, by means of a first developing assembly 7*a* among developing assemblies 7*a* to 7*d* attached to a developing unit 24 which is rotatable in the direction of an arrow. The toner image (the first color) thus formed on the photosensitive drum 1 is transferred by means of a transfer charging assembly 62 to a transfer material 15 held on the transfer drum 60 by the gripper 61. Transfer residual toner remaining on the surface of the photosensitive drum 1 after transfer is collected by a cleaner 19 having a cleaning blade coming in contact with the surface of the photosensitive drum 1, thus the photosensitive drum 1 is cleaned.

In the transfer charging assembly 62, a corona charging assembly or a contact charging assembly is used. In the case where the corona charging assembly is used in the transfer charging assembly 62, a voltage of −10 kV to +10 kV is applied, and transfer electric current is set at −500 μA to +500 μA. On the peripheral surface of the transfer drum 60, a holding member is put. This holding member is formed of a film-like dielectric sheet such as polyvinylidene fluoride resin film or polyethylene terephthalate film. For example, a sheet with a thickness of from 100 μm to 200 μm and a volume resistivity of from $10^{12}$ to $10^{14}$ Ω·cm is used.

Next, for the second color, the developing unit is rotated until the developing assembly 7*b* faces the photosensitive drum 1. Then, a second-color electrostatic latent image is developed with a second toner by means of the developing assembly 7*b*, and the toner image thus formed is also transferred and superimposed onto the same transfer material 15 as the above.

Similar operation is also repeated for the third and fourth colors. Thus, the transfer drum 60 is rotated given times while the transfer material 15 is kept gripped thereon, so that the toner images corresponding to the number of given colors are multiple-transferred to the transfer material. Transfer electric current for electrostatic transfer may preferably be increased in the order of first color, second color, third color and fourth color so that the toners can be reduced remaining on the photosensitive drum 1 after transfer.

The transfer material 15 with the images multiple-transferred thereon has been completed is separated from the transfer drum 60 by means of the separation charging assemblies 63*a* and 63*b*. Then the toner images held thereon are fixed by means of a heat-and-pressure roller fixing assembly 23, and subjected to additive color mixing at the time of fixing, whereby a full-color image is formed.

Figure 8:
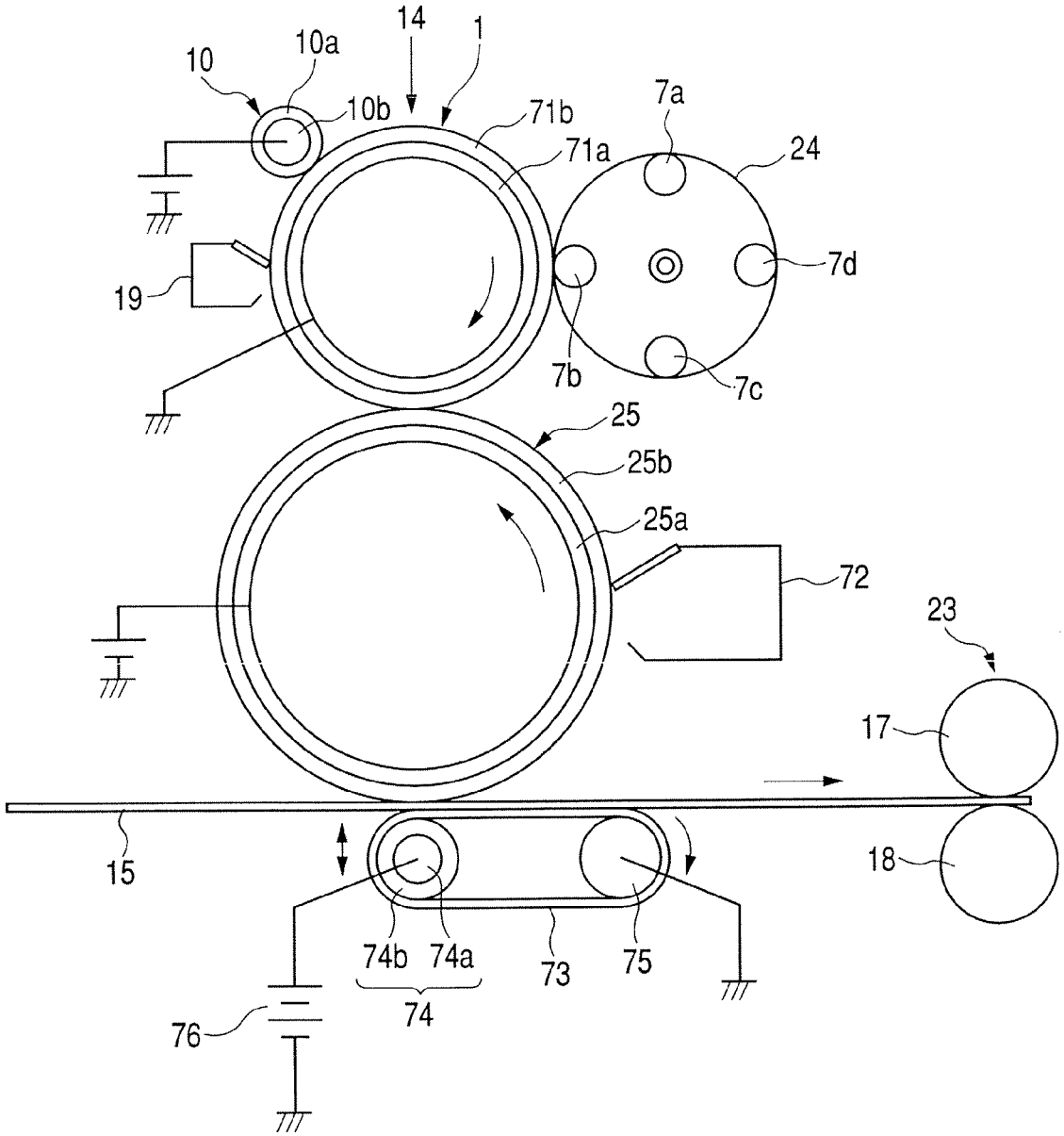
FIG. 8 schematically illustrates the constitution of a still further example of an apparatus practicing the image forming method of the present invention.

As an example of still another apparatus practicing the image forming method of the present invention, FIG. 8 schematically illustrates the constitution of an image apparatus employing a transfer belt as a secondary transfer means when four-color color toner images primarily transferred to an intermediate transfer drum are transferred collectively to a transfer material.

In the apparatus shown in FIG. 8, a cyan toner, a magenta toner, a yellow toner and a black toner are introduced into developing assemblies 7*a* to 7*d*, respectively. Electrostatic latent images formed on a photosensitive drum 1 are developed to form toner images of respective colors on the photosensitive drum 1. The photosensitive drum 1 has a photoconductive insulating material layer 71*b* formed of OPC, a-Si or the like, and is rotated in the direction of an arrow by means of a drive system (not shown). A photosensitive member having as a photosensitive layer 71*a* an amorphous silicon photosensitive layer or an organic photosensitive layer may preferably be used.

The organic photosensitive layer may be of a single-layer type in which the photosensitive layer contains a charge generating material and a charge transporting material in the same layer, or may be a function-separated photosensitive layer composed of a charge transport layer and a charge generation layer. A multi-layer type photosensitive layer comprising a conductive substrate, and the charge generation layer and the charge transport layer in this order superimposed thereon is one of preferred examples.

As binder resins for the organic photosensitive layer, polycarbonate resins, polyester resins or acrylic resins provide especially good transfer performance and cleaning performance, and may hardly cause faulty cleaning, melt-adhesion of toner to the photosensitive member and filming of external additives.

The charging step is carried out utilizing a system making use of a corona charging assembly and being in non-contact with the photosensitive drum 1, or a contact type system making use of a roller or the like. Both systems may be used. The contact type system as shown in FIG. 8 may preferably be used so as to effect efficient and uniform charging, simplify the system and reduce ozone.

A charging roller 10 is constituted basically of a mandrel 10*b* at the center and a conductive elastic layer 10*a* forming the periphery. The charging roller 10 is kept in pressure contact with the surface of the photosensitive drum 1 at certain pressing force and is rotated following the rotation of the photosensitive drum 1.

As preferable process conditions when the charging roller 10 is used, they are the same as those of the apparatus shown in FIG. 3.

The toner image on the photosensitive drum 1 is transferred to an intermediate transfer drum 25 to which a voltage (e.g., ±0.1 to ±5 kV) is applied. The surface of the photosensitive drum 1 after transfer is cleaned by a cleaner 19 having a cleaning blade.

The intermediate transfer drum 25 is provided in contact with the bottom part of the photosensitive drum 1, being axially supported in parallel with the photosensitive drum 1, and is rotated at the same peripheral speed as the photosensitive drum 1 and in the anti-clockwise direction as shown by an arrow.

The first-color toner image formed and held on the surface of the photosensitive drum 1 is, in the course of passing through a transfer nip where the photosensitive drum 1 and the intermediate transfer drum 25 come into contact, transferred intermediately sequentially to the peripheral surface of the intermediate transfer drum 25 by the aid of an electric filed formed at a transfer nip region by a transfer bias applied to the intermediate transfer drum 25.

If necessary, after the toner image has been transferred to the transfer material 15, the surface of the intermediate transfer drum 25 may be cleaned by a cleaning means 72 which can come in contact with or separate from it. When the toner is present on the intermediate transfer drum 25, the cleaning means 72 is separated from the surface of the intermediate transfer drum 25 so as not to disturb the toner image.

A transfer means 73 is provided in contact with the bottom part of the intermediate transfer drum 25, and is axially supported in parallel with the intermediate transfer drum 25. The transfer means is, e.g., a transfer roller or a transfer belt, and is rotated at the same peripheral speed as the intermediate transfer drum 25 in the clockwise direction as shown by an arrow. The transfer means 73 may be so provided that it comes into direct contact with the intermediate transfer drum 25, or may be so disposed that a belt or the like comes into contact with the intermediate transfer drum 25 and the transfer means 73, or with them therebetween.

In the case where the transfer means is the transfer roller, it is constituted basically of a mandrel at the center and a conductive elastic layer forming the periphery.

The intermediate transfer drum and the transfer roller may be formed of commonly available materials. The elastic layer of the transfer roller may be made to have a volume resistivity set too be smaller than the volume resistivity of the elastic layer 25*b* of the intermediate transfer drum 25, whereby the voltage applied to the transfer roller can be lessened, good toner images can be formed on the transfer material 15 and also the transfer material 15 can be prevented from being wound around the intermediate transfer drum 25. In particular, the elastic layer 25*b* of the intermediate transfer drum 25 may preferably have a volume resistivity at least 10 times the volume resistivity of the elastic layer of the transfer roller.

The hardness of the intermediate transfer drum and transfer roller is measured according to JIS K 6301. The intermediate transfer drum 25 used in the present invention may preferably be composed of an elastic layer with hardness in the range of from 10 to 40 degrees. As for the hardness of the transfer roller, the transfer roller may preferably have an elastic layer with hardness higher than the hardness of the elastic layer 25*b* of the intermediate transfer drum 25 and has a value of from 41 to 80 degrees, in order to prevent the transfer material 15 from being wound around the intermediate transfer drum 25. If the hardness of the intermediate transfer drum 25 and the hardness of the transfer roller are reversed, a concave or indentation may be formed on the transfer roller side, tending to cause the transfer material 15 to wind around the intermediate transfer drum 25.

As shown in FIG. 8, a transfer belt 73 is provided below the intermediate transfer drum 25. The transfer belt 73 is fitted over and around a bias roller 74 and a tension roller 75 which are provided in parallel with the axis of the intermediate transfer drum 25, and is driven by a drive means (not shown). The transfer belt 73 is so set up that the bias roller 74 side is movable in the directions of an arrow around the tension roller 75 side as an axis, coming in contact with, or separating from, the intermediate transfer drum 25 from beneath in the directions of the arrow. To the bias roller 74, a desired secondary transfer bias is applied by a secondary transfer bias source 76, whereas the tension roller 75 is grounded.

Then, as the transfer belt 73, used is, e.g., a rubber belt comprising an about 300 μm thick thermosetting urethane elastomer in which carbon black has been dispersed so as to be controlled to have a volume resistivity of $10^8$ to $10^{12}$ Ω·cm (at the time of application of 1 kV) and on which a 20 μm thick fluororubber layer controlled to have a volume resistivity of $10^{15}$ Ω·cm (at the time of application of 1 kV) is formed. It has the shape of a tube having an external size of 80 mm in peripheral length and 300 mm in width.

The transfer belt 73 described above is kept elongated by about 5% by tension applied by the aid of the above bias roller 74 and tension roller 75.

The transfer belt 73 is rotated at a speed equal to, or different from, the peripheral speed of the intermediate transfer drum 25. The transfer material 15 is transported between the intermediate transfer drum 25 and the transfer belt 73 and at the same time a bias with a polarity reverse to triboelectric charges of the toner is applied to the transfer belt 73 from the bias power source 76, so that the toner image on the intermediate transfer drum 25 is transferred to the surface side of the transfer material 15.

A rotating member for transfer may be made of the same material as that used in the charging roller. Transfer may preferably be performed under process conditions of a roller contact pressure of 5 to 500 g/cm and a DC voltage of ±0.2 to ±10 kV.

A conductive elastic layer 74*b* of the bias roller 74 is made of, e.g., an elastic material having a volume resistivity of $10^6$ to $10^{10}$ Ω·cm, such as a polyurethane, or an ethylene-propylene-diene type terpolymer (EPDM), with a conducting material such as carbon dispersed therein. A bias is applied to a mandrel 74*a* by a constant voltage power source. As bias conditions, a voltage of from ±0.2 to ±10 kV is preferred.

Subsequently, the transfer material 15 is transported to a fixing assembly 23 comprised basically of a heating member 18 provided internally with a heating element such as a halogen heater and an elastic-material pressure member 17 brought into pressure contact therewith under pressing force, and is passed between the heating member 18 and the pressure member 17, thus the multiple toner image is fixed by heat and pressure to the transfer material 15.

EXAMPLES

Examples 1 to 5 and Comparative Examples 1 to 3

Toner Production Example 1

Example 1

To 900 parts by weight of ion-exchanged water heated to 70° C., 3 parts by weight of tricalcium phosphate was added, and these were stirred at 10,000 rpm using a TK-type homomixer (manufactured by Tokushu Kika Kogyo Co., Ltd.) to prepare an aqueous medium.

| | (by weight) |
|---|---|
| Styrene | 80 parts |
| n-Butyl acrylate | 20 parts |
| Divinylbenzene | 0.5 part |
| Saturated polyester resin (polycondensation product of propylene oxide modified bisphenol A and isophthalic acid; Tg: 65° C.; Mn: 17,000; Mw/Mn: 2.4) | 4.5 parts |
| Salicylic acid aluminum compound (BONTRON E-88, available from Orient Chemical Industries, Ltd.) | 1 part |
| C.I. Pigment Blue 15:3 | 10 parts |

The above materials were uniformly dispersed and mixed by means of an attritor (manufactured by Mitsui Miike Engineering Corporation) to prepare a polymerizable monomer composition. The polymerizable monomer composition was heated to 70° C., and 9 parts by weight of an ester wax (maximum endothermic peak in DSC measurement: 67° C.) composed chiefly of stearyl stearate was added thereto and mixed to effect dissolution. In the monomer mixture obtained, 3 parts by weight of a polymerization initiator 2,2'-azobis-2-methylbutyronitrile was dissolved to prepare a polymerizable monomer mixture.

The polymerizable monomer mixture was introduced into the above aqueous medium, and stirred at 70° C. and for 7 minutes at 10,000 rpm by means of a TK-type homomixer in an atmosphere of $N_2$ to carry out granulation. Thereafter, with stirring by means of a paddle stirring blade, the reaction was carried out for 6 hours at 70° C. which was 3° C. higher than the 10-hour half-life temperature of the polymerization initiator. Thereafter, the liquid temperature was raised to 80° C., and the stirring was continued for further 4 hours. After the reaction was completed, the suspension formed was cooled to room temperature (25° C.) at a cooling rate of −5° C./min.

To the suspension having been cooled to room temperature (25° C.), hydrochloric acid was added to dissolve the tricalcium phosphate, followed by filtration and then washing with water, obtaining wet cyan toner particles.

Next, the above cyan toner particles were dried at 40° C. for 12 hours to produce cyan toner particles with a weight-average particle diameter of 7.6 μm. 100 parts by weight of the cyan toner particles and 0.7 part by weight of hydrophobic fine silica powder treated with a silicone oil and having a BET value (specific surface area) of 200 $m^2/g$ and a primary particle diameter of 12 nm were mixed by means of a Henschel mixer (manufactured by Mitsui Miike Engineering Corporation) to produce Toner 1 (cyan toner). Physical properties of Toner 1 (cyan toner) are shown in Table 1.

Toner Production

Example 2

| | (by weight) |
|---|---|
| Styrene | 78 parts |
| n-Butyl acrylate | 22 parts |
| Divinylbenzene | 0.5 part |
| Saturated polyester resin (polycondensation product of propylene oxide modified bisphenol A and isophthalic acid; Tg: 65° C.; Mn: 17,000; Mw/Mn: 2.4) | 0.5 part |
| Salicylic acid aluminum compound (BONTRON E-88, available from Orient Chemical Industries, Ltd.) | 1 part |
| C.I. Pigment Blue 15:3 | 10 parts |

Cyan toner particles were obtained in the same manner as in Toner Production Example 1 except that the above materials were dispersed by means of an attritor and the ester wax was added in an amount changed to 11 parts by weight.

Using the cyan toner particles, Toner 2 (cyan toner) was obtained in the same manner as in Toner Production Example 1. Physical properties of Toner 2 (cyan toner) are shown in Table 1.

Toner Production Example 3

Example 3

To 900 parts by weight of ion-exchanged water heated to 68° C., 3 parts by weight of tricalcium phosphate was added, and stirred at 10,000 rpm using a TK-type homomixer (manufactured by Tokushu Kika Kogyo Co., Ltd.) to prepare an aqueous medium.

| | (by weight) |
|---|---|
| Styrene | 80 parts |
| n-Butyl acrylate | 20 parts |
| Saturated polyester resin (polycondensation product of propylene oxide modified bisphenol A and isophthalic acid; Tg: 65° C.; Mn: 17,000; Mw/Mn: 2.4) | 4.2 parts |
| Salicylic acid aluminum compound (BONTRON E-88, available from Orient Chemical Industries, Ltd.) | 1 part |
| C.I. Pigment Blue 15:3 | 12 parts |

The above materials were uniformly dispersed and mixed by means of an attritor (manufactured by Mitsui Miike Engineering Corporation) to prepare a polymerizable monomer composition. The polymerizable monomer composition was heated to 68° C., and 14 parts by weight of an ester wax (maximum endothermic peak in DSC measurement: 72° C.) composed chiefly of behenyl behenate was added thereto and mixed to effect dissolution. In the monomer mixture obtained, 3 parts by weight of a polymerization initiator 2,2'-azobis-2-methylbutyronitrile was dissolved to prepare a polymerizable monomer mixture.

The polymerizable monomer mixture was introduced into the above aqueous medium, and stirred at 68° C. and for 7 minutes at 10,000 rpm by means of a TK-type homomixer in an atmosphere of $N_2$ to carry out granulation. Thereafter, with stirring by means of a paddle stirring blade, the reaction was carried out for 6 hours at 68° C. which was higher 1° C. higher than the 10-hour half-life temperature of the polymerization initiator. Thereafter, the liquid temperature was raised to 80° C., and the stirring was continued for further 4 hours. After the reaction was completed, the suspension formed was cooled to room temperature (25° C.) at a cooling rate of −5° C./min.

To the suspension having been cooled to room temperature (25° C.), hydrochloric acid was added to dissolve the tricalcium phosphate, followed by filtration and then washing with water to produce wet cyan toner particles.

Next, the wet cyan toner particles were dried at 40° C. for 12 hours to produce cyan toner particles with a weight-average particle diameter of 7.4 μm. 100 parts by weight of the cyan toner particles obtained and 0.05 part by weight of hydrophobic fine silica powder treated with a silicone oil and having a BET value (specific surface area) of 200 $m^2/g$ and a primary particle diameter of 12 nm were mixed by means of a Henschel mixer (manufactured by Mitsui Miike Engineering Corporation) to produce Toner 3 (cyan toner) Physical properties of Toner 3 (cyan toner) are shown in Table 1.

Toner Production Example 4

Example 4

4-1. Synthesis of Toner Binder (1)

Into a reaction tank provided with a cooling tube, a stirrer and a nitrogen feed tube, 724 parts by weight of bisphenol-A ethylene oxide 2-mole addition product, 276 parts by weight of isophthalic acid and 2 parts by weight of dibutyltin oxide were introduced, and the reaction was carried out at 230° C. for 8 hours under normal pressure. Thereafter, the reaction was further carried out for 5 hours under a reduced pressure of 10 to 15 mmHg. The reaction product obtained was cooled to 160° C., and 32 parts by weight of phthalic anhydride was added to carry out the reaction for 2 hours, cooled to 80° C., and then allowed to react for 2 hours with 188 parts by weight of isophorone diisocyanate in ethyl acetate to produce an isocyanate-containing prepolymer (1). Next, 267 parts by weight of this prepolymer (1) and 14 parts by weight of isophorone diamine were allowed to react at 50° C. for 2 hours to produce a urea modified polyester resin (1) with a weight-average molecular weight of 64,000.

As with the foregoing, 724 parts by weight of bisphenol-A ethylene oxide 2-mole addition product and 276 parts by weight of terephthalic acid were subjected to polycondensation at 230° C. for 8 hours under normal pressure. Then, the reaction was further carried out for 5 hours under a reduced pressure of 10 to 15 mmHg to produce an unmodified polyester resin (a) with a weight-average molecular weight of 5,000.

200 parts by weight of the urea modified polyester resin (1) and 800 parts by weight of the unmodified polyester resin (a) were dissolved and mixed in 2,000 parts by weight of an ethyl acetate/ethyl methyl ketone (MEK) (1/1) mixed solvent to prepare an ethyl acetate/MEK solution of a toner binder (1). A portion thereof was dried under reduced pressure to prepare the toner binder (1). The Tg of the toner binder (1) was 62° C.

4-2. Production of Toner Particles

Into a beaker, 300 parts by weight of the ethyl acetate/MEK solution of the toner binder (1), 9 parts by weight of an ester wax (maximum endothermic peak in DSC measurement: 67° C.) composed chiefly of stearyl stearate and 6 parts by weight of C.I. Pigment Blue 15:3 as a cyan pigment were introduced, and stirred at 60° C. and at 12,000 rpm by means of a TK type homomixer to effect uniform dissolution and dispersion to prepare a toner material fluid.

Into a beaker, 706 parts by weight of ion-exchanged water, 294 parts by weight of a hydroxyapatite 10% suspension (SUPATITE, available from Nippon Chemical Industrial Co., Ltd.) and 0.2 part by weight of sodium dodecylbenzenesulfonate were introduced, and were uniformly dissolved. Then, the solution obtained was heated to 60° C., and, with stirring at 12,000 rpm by means of a TK type homomixer, the above toner material fluid was introduced therein, and stirred for 10 minutes. Then, the liquid mixture obtained was moved to a Kolben (flask) provided with a stirring rod and a thermometer, and then heated to 98° C. to remove the solvent, followed by filtration, washing and then drying, and further followed by air classification to produce cyan toner particles with a weight-average particle diameter of 6.4 μm.

100 parts by weight of the cyan toner particles obtained and 2.5 parts by weight of hydrophobic fine silica powder treated with a silicone oil and having a BET value (specific surface area) of 200 $m^2/g$ and a primary particle diameter of 12 nm were mixed by means of a Henschel mixer (manufactured by Mitsui Miike Engineering Corporation) to produce Toner 4 (cyan toner). Physical properties of Toner 4 (cyan toner) are shown in Table 1.

Toner Production

Example 5

Comparative Example 1

To 900 parts by weight of ion-exchanged water heated to 73° C., 3 parts by weight of tricalcium phosphate was added, and stirred at 10,000 rpm using a TK-type homomixer (manufactured by Tokushu Kika Kogyo Co., Ltd.) to prepare an aqueous medium.

| | (by weight) |
|---|---|
| Styrene | 80 parts |
| n-Butyl acrylate | 20 parts |
| Divinylbenzene | 0.5 part |
| Ethylene glycol diacrylate | 2.1 parts |
| Saturated polyester resin (polycondensation product of propylene oxide modified bisphenol A and isophthalic acid; Tg: 62° C.; Mn: 17,000; Mw/Mn: 2.4) | 1.0 part |
| Salicylic acid aluminum compound (BONTRON B-88, available from Orient Chemical Industries, Ltd.) | 1 part |
| C.I. Pigment Blue 15:3 | 10 parts |

The above materials were uniformly dispersed and mixed by means of an attritor (manufactured by Mitsui Miike Engineering Corporation) to prepare a polymerizable monomer composition. This polymerizable monomer composition was heated to 73° C., and 0.7 part by weight of an ester wax (maximum endothermic peak in DSC measurement: 72° C.) composed chiefly of stearyl stearate was added thereto and mixed to effect dissolution. In the monomer mixture obtained, 2 parts by weight of a polymerization initiator 2,2'-azobis-2-methylbutyronitrile was dissolved to prepare a polymerizable monomer mixture.

The polymerizable monomer mixture was introduced into the above aqueous medium, and stirred at 73° C. and for 7 minutes at 10,000 rpm by means of a TK-type homomixer (manufactured by Tokushu Kika Kogyo Co., Ltd.) in an atmosphere of $N_2$ to carry out granulation. Thereafter, with stirring by means of a paddle stirring blade, the reaction was carried out for 6 hours at 73° C. which was 6° C. higher than the 10-hour half-life temperature of the polymerization initiator. Thereafter, the liquid temperature was raised to 80° C., and the stirring was continued for further 4 hours. After the reaction was completed, the suspension formed was cooled to room temperature (25° C.) at a cooling rate of −5° C./min.

To the suspension having been cooled to room temperature (25° C.), hydrochloric acid was added to dissolve the tricalcium phosphate, followed by filtration and then washing with water to produce wet cyan toner particles.

Next, the wet cyan toner particles were dried at 40° C. for 12 hours to produce cyan toner particles with a weight-average particle diameter of 7.0 μm.

100 parts by weight of the cyan toner particles and 0.7 part by weight of hydrophobic fine titanium oxide powder having a BET value (specific surface area) of 150 $m^2/g$ and a primary particle diameter of 30 nm were mixed by means of a Henschel mixer (manufactured by Mitsui Miike Engineering Corporation) to produce Toner 5 (cyan toner). Physical properties of Toner 5 (cyan toner) are shown in Table 1.

Toner Production Example 6

Comparative Example 2

To 900 parts by weight of ion-exchanged water heated to 70° C., 3 parts by weight of tricalcium phosphate was added, and stirred at 10,000 rpm using a TK-type homomixer (manufactured by Tokushu Kika Kogyo Co., Ltd.) to prepare an aqueous medium.

| | (by weight) |
|---|---|
| Styrene | 85 parts |
| n-Butyl acrylate | 15 parts |
| Divinylbenzene | 0.5 part |
| Saturated polyester resin (polycondensation product of propylene oxide modified bisphenol A and isophthalic acid; Tg: 62° C.; Mn: 17,000; Mw/Mn: 2.4) | 0.5 part |
| Salicylic acid aluminum compound (BONTRON E-88, available from Orient Chemical Industries, Ltd.) | 1 part |
| C.I. Pigment Blue 15:3 | 10 parts |

The above materials were uniformly dispersed and mixed by means of an attritor (manufactured by Mitsui Miike Engineering Corporation) to prepare a polymerizable monomer composition. This polymerizable monomer composition was heated to 70° C., and 18 parts by weight of an ester wax (maximum endothermic peak in DSC measurement: 72° C.) composed chiefly of stearyl stearate was added thereto and mixed to effect dissolution. In the monomer mixture obtained, 3 parts by weight of a polymerization initiator 2,2'-azobis-2-methylbutyronitrile was dissolved to prepare a polymerizable monomer mixture.

The polymerizable monomer mixture was introduced into the above aqueous medium, and stirred at 70° C. and for 7 minutes at 10,000 rpm by means of a TK-type homomixer (manufactured by Tokushu Kika Kogyo Co., Ltd.) in an atmosphere of $N_2$ to carry out granulation. Thereafter, with stirring by means of a paddle stirring blade, the reaction was carried out for 6 hours at 70° C. which was higher by 3° C. than the 10-hour half-life temperature of the polymerization initiator. Thereafter, the liquid temperature was raised to 80° C., and the stirring was continued for further 4 hours. After the reaction was completed, the suspension formed was cooled to room temperature (25° C.) at a cooling rate of −15° C./min.

To the suspension having been cooled to room temperature (25° C.), hydrochloric acid was added to dissolve the tricalcium phosphate, followed by filtration and then washing with water to produce wet cyan toner particles.

Next, the wet cyan toner particles were dried at 40° C. for 12 hours to produce cyan toner particles with a weight-average particle diameter of 7.4 μm.

100 parts by weight of the cyan toner particles and 0.1 part by weight of hydrophobic fine titanium oxide powder having a BET value (specific surface area) of 150 $m^2/g$ and a primary particle diameter of 30 nm were mixed by means of a Henschel mixer (manufactured by Mitsui Miike Engineering Corporation) to produce Toner 6 (cyan toner). Physical properties of Toner 6 (cyan toner) are shown in Table 1.

Toner Production Example 7

Comparative Example 3

Into a reaction tank provided with a cooling tube, a stirrer and a nitrogen feed tube, 704 parts by weight of bisphenol-A ethylene oxide 2-mole addition product, 296 parts by weight of isophthalic acid and 2 parts by weight of dibutyltin oxide were introduced, and allowed to react at 230° C. for 8 hours under normal pressure. Thereafter, the reaction was further carried out for 5 hours under a reduced pressure of 10 to 15 mmHg. The reaction product obtained was cooled to 160° C., and 30 parts by weight of phthalic anhydride was added thereto, and allowed to react for 2 hours, then cooled to 80° C., and further allowed to react for 2 hours with 188 parts of isophorone diisocyanate in ethyl acetate to produce an isocyanate-containing prepolymer (2). Next, 267 parts by weight of this prepolymer (2) and 14 parts by weight of isophorone diamine were allowed to react at 50° C. for 2 hours to produce a urea modified polyester resin (2) with a weight-average molecular weight of 66,000. The Tg of the urea modified polyester resin (2) was 66° C.

100 parts by weight of the urea modified polyester resin (2) was dissolved and mixed with 200 parts by weight of an ethyl acetate/ethyl methyl ketone (MEK) (1/1).

Into the solution obtained, 19 parts by weight of an ester wax urea (maximum endothermic peak in DSC measurement: 72° C.) composed chiefly of behenyl behenate and 6 parts by weight of C.I. Pigment Blue 15:3 as a cyan pigment were introduced, and stirred at 70° C. and at 12,000 rpm by means of a TK type homomixer to effect uniform dissolution and dispersion to prepare a toner material fluid.

Into a beaker, 706 parts by weight of ion-exchanged water, 294 parts by weight of a hydroxyapatite 10% suspension (SUPATITE, available from Nippon Chemical Industrial Co., Ltd.) and 0.2 part by weight of sodium dodecylbenzenesulfonate were introduced, and were uniformly dissolved. Then, the solution obtained was heated to 73° C., and, with stirring at 12,000 rpm by means of a TK type homomixer, the above toner material fluid was introduced therein, and these were stirred for 10 minutes. Then, the liquid mixture obtained was moved to a Kolben (flask) provided with a stirring rod and a thermometer, and then heated to 98° C. to remove the solvent, followed by filtration, washing and then drying, and further followed by air classification to produce cyan toner particles with a weight-average particle diameter of 6.0 μm.

100 parts by weight of the cyan toner particles obtained and 0.4 parts by weight of hydrophobic fine silica powder having a BET value (specific surface area) of 200 $m^2/g$ and a primary particle diameter of 12 nm were mixed by means of a Henschel mixer (manufactured by Mitsui Miike Engineering Corporation) to produce Toner 7 (cyan toner). Physical properties of Toner 7 (cyan toner) are shown in Table 1.

Toner Production Example 8

Example 5

Toner particles 8 and Toner 8 (cyan toner) were obtained in the same manner as in Toner Production Example 1 except that, in place of the ester wax composed chiefly of stearyl stearate, 7 parts by weight of Fischer-Tropsch wax (FT-100, available from Nippon Seiro Co., Ltd.; maximum endothermic peak in DSC measurement: 88° C.) was added, mixed and dissolved.

Physical properties of Toner 8 (cyan toner) are shown in Table 1.

Toner Production Example 9

Comparative Example 4

To 900 parts by weight of ion-exchanged water heated to 60° C., 3 parts by weight of tricalcium phosphate was added, and these were stirred at 10,000 rpm using a TK-type homomixer (manufactured by Tokushu Kika Kogyo Co., Ltd.) to prepare an aqueous medium.

| | (by weight) |
|---|---|
| Styrene | 80 parts |
| n-Butyl acrylate | 20 parts |
| Divinylbenzene | 2 parts |
| Saturated polyester resin (polycondensation product of propylene oxide modified bisphenol A and isophthalic acid; Tg: 65° C.; Mn: 17,000; Mw/Mn: 2.4) | 5 parts |

-continued

| | (by weight) |
|---|---|
| Salicylic acid aluminum compound (BONTRON E-88, available from Orient Chemical Industries, Ltd.) | 1 part |
| C.I. Pigment Blue 15:3 | 10 parts |
| Ester wax composed chiefly of stearyl stearate (maximum endothermic peak in DSC measurement: 67° C.) | 9 parts |

The above materials were uniformly dispersed and mixed by means of an attritor (manufactured by Mitsui Miike Engineering Corporation) to prepare a polymerizable monomer composition. This polymerizable monomer composition was heated to 60° C., and 4 parts by weight of a polymerization initiator lauroyl peroxide (10-hour half-life temperature: 62° C.) was dissolved in the polymerizable monomer composition thus heated, to prepare a polymerizable monomer mixture.

The polymerizable monomer mixture was introduced into the above aqueous medium, and stirred at 60° C. and for 7 minutes at 10,000 rpm by means of a TK-type homomixer in an atmosphere of $N_2$ to carry out granulation. Thereafter, with stirring by means of a paddle stirring blade, the reaction was carried out for 6 hours at 60° C. which was 2° C. lower than the 10-hour half-life temperature of the polymerization initiator. Thereafter, the liquid temperature was raised to 80° C., and the stirring was continued for further 4 hours. After the reaction was completed, the suspension formed was cooled to room temperature (25° C.) at a cooling rate of −1° C./min.

To the suspension having been cooled to room temperature (25° C.), hydrochloric acid was added to dissolve the tricalcium phosphate, followed by filtration and then washing with water to produce wet cyan toner particles.

Next, the wet cyan toner particles were dried at 45° C. for 12 hours to produce cyan toner particles with a weight-average particle diameter of 7.7 μm.

100 parts by weight of the cyan toner particles and 0.7 part by weight of hydrophobic fine silica powder having a BET value (specific surface area) of 200 $m^2/g$ and a primary particle diameter of 12 nm were mixed by means of a Henschel mixer (manufactured by Mitsui Miike Engineering Corporation) to produce Toner 9 (cyan toner). Physical properties of Toner 9 (cyan toner) are shown in Table 1.

TABLE 1

| | Toner formulation | | | | | | Physical properties of toner and toner particles | | | | |
|---|---|---|---|---|---|---|---|---|---|---|---|
| | Binder resin | | Release agent | | External additive | | Storage elastic modulus at 140° C., | | | Shape factor | |
| | Chief component | Amt. (pbw) | Type | Amt. (pbw) | Type | Amt. (pbw) | G' (140° C.) ($dN/m^2$) | (1) (° C.) | (2) (vol. %) | SF-1 | Tg (° C.) |
| Toner 1: | St-Ac | 100 | Wax 1 | 9 | Hydrophobic silica | 0.7 | $7.0 \times 10^3$ | 117 | 50 | 117 | 54 |
| Toner 2: | St-Ac | 100 | Wax 1 | 11 | Hydrophobic silica | 0.7 | $1.5 \times 10^4$ | 127 | 57 | 121 | 50 |
| Toner 3: | St-Ac | 100 | Wax 2 | 14 | Hydrophobic silica | 0.05 | $3.1 \times 10^3$ | 123 | 27 | 127 | 53 |
| Toner 4: | PES | 100 | Wax 1 | 9 | Hydrophobic silica | 2.5 | $9.1 \times 10^3$ | 120 | 63 | 104 | 60 |

TABLE 1-continued

| | Toner formulation | | | | | | Physical properties of toner and toner particles | | | | |
|---|---|---|---|---|---|---|---|---|---|---|---|
| | Binder resin | | | | | | Storage elastic modulus | | | Shape | |
| | Chief | | Release agent | | External additive | | at 140° C., | | | fac- | |
| | compo-nent | Amt. (pbw) | Type | Amt. (pbw) | Type | Amt. (pbw) | G' (140° C.) (dN/m$^2$) | (1) (° C.) | (2) (vol. %) | tor SF-1 | Tg (° C.) |
| Toner 5: | St-Ac | 100 | Wax 1 | 0.1 | Untreated Ti oxide | 0.7 | $1.0 \times 10^3$ | 137 | 33 | 124 | 53 |
| Toner 6: | St-Ac | 100 | Wax 1 | 18 | Untreated Ti oxide | 0.1 | $7.0 \times 10^3$ | 105 | 67 | 122 | 62 |
| Toner 7: | PES | 100 | Wax 2 | 19 | Hydrophobic silica | 0.4 | $4.2 \times 10^4$ | 122 | 55 | 133 | 65 |
| Toner 8: | St-Ac | 100 | Wax 3 | 7 | Hydrophobic silica | 0.7 | $9.7 \times 10^3$ | 124 | 47 | 115 | 54 |
| Toner 9: | St-Ac | 100 | Wax 1 | 9 | Hydrophobic silica | 0.7 | $5.5 \times 10^4$ | 133 | 52 | 116 | 53 |

(1) Temperature at which the toner comes to have a viscosity of $1.0 \times 10^3$ Pa · s by the flow tester heating method
(2) Methanol concentration in water at the time the transmittance is 50% in wettability test
Wax 1: Ester wax (endothermic peak: 67° C.) composed chiefly of stearyl stearate.
Wax 2: Ester wax (endothermic peak: 72° C.) composed chiefly of behenyl behenate.
Wax 3: Fischer Tropsch wax FT-100 (endothermic peak: 88° C.)

—Image Evaluation—

Using Toner 1 to Toner 9 obtained, images were evaluated according to the following methods.

A modified machine of a commercially available color laser printer LBP2410 (manufactured by CANON INC.) was used as the image forming apparatus, and evaluation was made in an environment of temperature 10° C. and humidity 50% RH.

Alteration points of the evaluation machine are as follows:

(1) The software was so altered that a monochromatic printing mode which could operate with only a black cartridge could also operate with different-color cartridges.
(2) The software was so altered that fixing speed was changeable to any desired values.
(3) The fixing assembly was so altered that fixing speed was changeable to any desired values.

Image formation speeds (developing roller rotational speed, developing drum rotational speed and so forth) were not changed.

Cyan cartridges were used for evaluation. From commercially available cartridges, toners held therein were removed, and, after their interiors were cleaned by air blowing, 160 g each of Toners 1 to 9 were put respectively into them to make evaluation. Toner contained in each station of the magenta station, yellow station and black station of the evaluation machine was taken out, and the magenta cartridge, yellow cartridge and black cartridge whose remaining-toner-amount detecting mechanisms were deactivated were inserted, carrying out evaluation of each of the cyan toners (Toners 1 to 9).

As transfer materials, two types of LETTER-size XEROX 4024 sheets (available from Xerox Corporation) of 75 g/m$^2$ and 105 g/m$^2$ in basis weight were used to carry out evaluation.

In respect of each of the above two types of transfer materials, a print image as shown in FIG. 1, having a print percentage of 4%, was continuously printed on 5,000 sheets. In both of the cases, image formation speed was set to be a speed in a plain-paper mode.

As to the fixing speed, it was set to be 190 mm/sec for both of the transfer materials, and the nip width was appropriately so controlled that any point on the transfer material takes 1/24 seconds to pass through the nip.

Using images on the first sheet, 1,000th sheet and 5,000th sheet for each of 75 g paper and 105 g paper, evaluation was made according to the following evaluation criteria. The results of evaluation are shown in Table 2.

Anti-offset:

Anti-offset was evaluated using the 105 g paper evaluation image.

Evaluation was made on the basis of whether or not the images in the all-solid band area and letter areas were seen on the transfer material in a fixing film cycle (i.e., whether offset occurred or not).

A: No offset is seen.
B: No offset is seen in the all-solid band area. Offset is somewhat seen in the letter S areas, but on the level of no problem in practical use.
C: Offset is somewhat seen in the all-solid band area, but on the level of no problem in practical use. In the letter S areas, offset is clearly seen.
D: Offset is clearly seen in both the all-solid band area and the letter S areas.

Image gloss uniformity:

Image gloss uniformity was evaluated using evaluation images of both 75 g paper and 105 g paper.

In respect of five spots of solid-image areas shown in FIG. 1, the glossiness of images was measured with a gloss meter PG-3G (manufactured by Nippon Denshoku Kogyo K.K.). The angle of incidence was set to be 75 degrees.

The difference between the maximum value and the minimum value in the values measured at the five spots was calculated, and evaluated in the following way.

A: The difference is less than 0.3.

B: The difference is 0.3 or more to less than 1.0.

C: The difference is 1.0 or more to less than 3.0.

D: The difference is 3.0 or more.

Storage stability/running performance:

Images which reflect the storage stability and running performance of toner were evaluated using the 75 g paper evaluation image.

Ten spots in non-image areas on the peripheries of the letter images were extracted at random, and the images were observed with an optical microscope at 100× to carry out evaluation in the following way.

A: No adhesion of toner particles.

B: Adhesion of toner particles in a very small quantity (1 to 10 in terms of toner particles) is seen, but no problem in practical use.

C: Adhesion of toner particles in a small quantity (10 to 30 in terms of toner particles) is seen.

D: Adhesion of toner particles in a large quantity is seen even without use of the optical microscope.

Image rub resistance:

In respect of the five spots of solid-image areas shown in FIG. 1, images were rubbed five times with Silbon paper to which a load of 50 g/cm$^2$ was applied. An arithmetic mean value of the rates of image density decrease after the rubbing was found and evaluation was made according to the following criteria.

Image density was measured with "Macbeth Reflection Densitometer" (manufactured by Macbeth Co.).

A: The rate of density decrease is less than 2%.

B: The rate of density decrease is 2% or more to less than 5%.

C: The rate of density decrease is 5% or more to less than 10%.

D: The rate of density decrease is 10% or more.

TABLE 2

| | Toner | Evaluation items | First sheet | 1,000th sheet | 5,000th sheet |
|---|---|---|---|---|---|
| Example: | | | | | |
| 1 | Toner 1 | Anti-offset | A | A | A |
| | | Image gloss uniformity (75 g paper/105 g paper) | A/A | A/A | A/A |
| | | Storage stability, running performance | A | A | A |
| | | Image rub resistance | A | A | A |
| 2 | Toner 2 | Anti-offset | A | A | A |
| | | Image gloss uniformity (75 g paper/105 g paper) | A/A | A/B | A/B |
| | | Storage stability, running performance | A | A | A |
| | | Image rub resistance | A | A | B |
| 3 | Toner 3 | Anti-offset | A | A | A |
| | | Image gloss uniformity (75 g paper/105 g paper) | A/A | A/A | A/B |
| | | Storage stability, running performance | A | A | A |
| | | Image rub resistance | A | A | B |
| 4 | Toner 4 | Anti-offset | A | A | A |
| | | Image gloss uniformity (75 g paper/105 g paper) | A/A | A/B | A/C |
| | | Storage stability, running performance | A | B | B |
| | | Image rub resistance | A | A | A |
| Comparative Example: | | | | | |
| 1 | Toner 5 | Anti-offset | C | D | D |
| | | Image gloss uniformity (75 g paper/105 g paper) | A/A | A/A | A/A |
| | | Storage stability, running performance | A | A | A |
| | | Image rub resistance | C | C | D |
| 2 | Toner 6 | Anti-offset | A | A | A |
| | | Image gloss uniformity (75 g paper/105 g paper) | A/A | A/A | A/A |
| | | Storage stability, running performance | C | D | D |
| | | Image rub resistance | A | B | B |
| 3 | Toner 7 | Anti-offset | A | A | A |
| | | Image gloss uniformity (75 g paper/105 g paper) | A/C | A/D | A/D |
| | | Storage stability, running performance | A | B | B |
| | | Image rub resistance | C | C | D |
| Example: | | | | | |
| 5 | Toner 8 | Anti-offset | A | A | A |
| | | Image gloss uniformity (75 g paper/105 g paper) | A/A | A/A | A/A |
| | | Storage stability, running performance | A | A | A |
| | | Image rub resistance | A | A | A |

TABLE 2-continued

| | Toner | Evaluation items | First sheet | 1,000th sheet | 5,000th sheet |
|---|---|---|---|---|---|
| Comparative Example: | | | | | |
| 4 | Toner 9 | Anti-offset | A | A | A |
| | | Image gloss uniformity (75 g paper/105 g paper) | A/C | A/C | A/D |
| | | Storage stability, running performance | A | A | A |
| | | Image rub resistance | B | B | B |

In addition, in each of the Examples and Comparative Examples, the same evaluation results as the above were obtained also when environment was changed to a normal-temperature and normal-humidity environment.

Example 6

Black toner (1), magenta toner (1) and yellow toner (1) were obtained in the same manner as in Toner Production Example 1 except that in place of C.I. Pigment Blue 15:3, 7 parts by weight of carbon black (surface area 60 $m^2/g$), 11 parts by weight of C.I. Pigment Red 122 and 10 parts by weight of C.I. Pigment Yellow 174 were used. Physical properties of these three kinds of toners are shown in Table 3.

A modified machine of a commercially available color laser printer LBP2410 (manufactured by CANON INC.) was used as the image forming apparatus, and evaluation was made in an environment of temperature 50° C. and humidity 50% RH.

Alteration points of the evaluation machine are as follows:

(1) The software was so altered that fixing speed could be changed to any desired values.
(2) The fixing assembly was so altered that fixing speed could be changed to any desired values.

Image formation speeds (developing roller rotational speed, developing drum rotational speed and so forth) were not changed.

Cartridges for LBP2410 were used for evaluation. From a commercially available cartridge, toner held therein was removed, and, after its interior was cleaned by air blowing, 160 g of Toner 1 was put into it. Subsequently, in the like manner, 160 g each of the magenta toner (1), yellow toner (1) and black toner (1) were put into the magenta cartridge, yellow cartridge and black cartridge, respectively .

As transfer materials, two types of LETTER-size XEROX 4024 sheets (available from Xerox Corporation) of 75 $g/m^2$ and 105 $g/m^2$ in basis weight were used to carry out evaluation.

In respect of each of the above two types of transfer materials, a J6 image of "Standard Test Pattern for Printers, 4th Edition" (JEIDA-46-1999) was successively printed on 5,000 sheets. In both the cases, image formation speed was set to be a speed in a plain-paper mode.

As to the fixing speed, it was set to be 90 mm/sec for both the transfer materials, and the nip width was appropriately so controlled that any point on the transfer material takes ⅛ seconds to pass through the nip.

Using images on the first sheet, 1,000th sheet and 5,000th sheet for each of 75 g paper and 105 g paper, the images were evaluated on the evaluation items shown previously. As a result, good results were obtained on all the items.

Comparative Example 5

Black toner (2), magenta toner (2) and yellow toner (2) were obtained in the same manner as in Toner Production Example 9 (Comparative Example 4) except that in place of C.I. Pigment Blue 15:3, 7 parts by weight of carbon black (surface area 60 $m^2/g$), 11 parts by weight of C.I. Pigment Red 122 and 10 parts by weight of C.I. Pigment Yellow 174 were used. Physical properties of these three kinds of toners are shown in Table 3.

Image evaluation was made in the same manner as in Example 6 except that Toner 9 and the black toner (2), magenta toner (2) and yellow toner (2) were used in place of Toner 1 and the black toner (1), magenta toner (1) and yellow toner (1), respectively.

Good results were obtained in respect of the images on any of the first sheet, 1,000th sheet and 5,000th sheet when 75 g paper was used as the transfer material. However, when 105 g paper was used as the transfer material, the color mixing performance was poor, and the fixing was insufficient at secondary- and tertiary-color portions (portions where toners of different colors are superimposed to form images) of the fixed images on the 1,000th sheet and 5,000th sheet, where part of the fixed images came off when rubbed with fingers.

TABLE 3

| | Toner formulation | | | | | | Physical properties of toner and toner particles | | | | |
|---|---|---|---|---|---|---|---|---|---|---|---|
| | Binder resin | | | | | | Storage elastic modulus | | | Shape | |
| | Chief | | Release agent | | External additive | | at 140° C., | | | fac- | |
| | compo-nent | Amt. (pbw) | Type | Amt. (pbw) | Type | Amt. (pbw) | G' (140° C.) ($dN/m^2$) | (1) (° C.) | (2) (vol. %) | tor SF-1 | Tg (° C.) |
| Toner 1: (cyan toner) | St-Ac | 100 | Wax 1 | 9 | Hpb* silica | 0.7 | $7.0 \times 10^3$ | 117 | 50 | 117 | 54 |
| Black toner (1): | St-Ac | 100 | Wax 1 | 9 | Hpb* silica | 0.7 | $9.6 \times 10^3$ | 124 | 32 | 121 | 53 |
| Magenta toner (1): | St-Ac | 100 | Wax 1 | 9 | Hpb* silica | 0.7 | $3.1 \times 10^3$ | 120 | 46 | 115 | 53 |
| Yellow toner (1): | St-Ac | 100 | Wax 1 | 9 | Hpb* silica | 0.7 | $2.4 \times 10^3$ | 116 | 52 | 119 | 54 |
| Toner 9: (cyan toner) | St-Ac | 100 | Wax 1 | 9 | Hpb* silica | 0.7 | $5.5 \times 10^4$ | 133 | 52 | 116 | 53 |
| Black toner (2): | St-Ac | 100 | Wax 1 | 9 | Hpb* silica | 0.7 | $8.1 \times 10^4$ | 138 | 33 | 123 | 54 |
| Magenta toner (2): | St-Ac | 100 | Wax 1 | 9 | Hpb* silica | 0.7 | $2.9 \times 10^4$ | 134 | 44 | 113 | 52 |
| Yellow toner (2): | St-Ac | 100 | Wax 1 | 9 | Hpb* silica | 0.7 | $2.1 \times 10^4$ | 131 | 50 | 116 | 52 |

*Hydrophobic
(1) Temperature at which the toner comes to have a viscosity of $1.0 \times 10^3$ Pa · s by the flow tester heating method
(2) Methanol concentration in water at the time the transmittance is 50% in wettability test
Wax 1: Ester wax (endothermic peak: 67° C.) composed chiefly of stearyl stearate.

Example 7

Image evaluation was made in the same manner as in Example 6 except that the fixing speed was set to be 200 mm/sec for all transfer materials and the nip width was appropriately so controlled that any point on the transfer material takes 1/24 seconds to pass through the nip.

As a result, good results were obtained on all the items.

In addition, in Examples 6 and 7 and Comparative Example 5, the same evaluation results as the above were obtained also when the environment was changed to a normal-temperature and normal-humidity environment.

What is claimed is:

1. An image forming method comprising:

a charging step of externally applying a voltage to a charging member to charge an electrostatic latent image bearing member;

a latent image formation step of forming an electrostatic latent image on the electrostatic latent image bearing member thus charged;

a developing step of bringing a toner layer formed of a toner held on the surface of a toner carrying member, into contact with the surface of the electrostatic latent image bearing member to develop the electrostatic latent image with the toner to form a toner image on the electrostatic latent image bearing member;

a transfer step of transferring the toner image to a transfer material via, or not via, an intermediate transfer member; and a fixing step of fixing the toner image held on the transfer material;

in said fixing step, any point on the transfer material taking 1/24 seconds to 1/8 seconds to pass through a fixing nip; and said toner comprising toner particles containing at least a binder resin and a colorant, and inorganic fine particles;

wherein;

said toner particles have a shape factor SF-1 of from 100 or more to less than 130;

said toner has a storage elastic modulus at 140° C., G' (140° C.), of from $2.0 \times 10^3$ $dN/m^2$ or more to less than $2.0 \times 10^4$ $dN/m^2$;

said toner comes to have a viscosity of $1.0 \times 10^3$ Pa·s according to the flow tester heating method at a temperature of from 115° C. or more to less than 130° C.; and where a wettability of said toner to a methanol/water mixed solvent is measured as transmittance of 780 nm wavelength light, the methanol concentration at the time the transmittance is 50% is within the range of from 30% by volume to 60% by volume.

2. The image forming method according to claim 1, wherein;

said toner has a storage elastic modulus at 140° C., G' (140° C.), of from $2.0 \times 10^3$ $dN/m^2$ or more to less than $1.0 \times 10^4$ $dN/m^2$; and said toner comes to have a viscosity of $1.0 \times 10^3$ Pa·s according to the flow tester heating method at a temperature of from 115° C. or more to less than 125° C.

3. The image forming method according to claim 1, wherein said toner has a shape factor SF-1 of from 100 or more to less than 125.

4. The image forming method according to claim 1, wherein said binder resin is primarily composed of a styrene-acrylate copolymer.

5. The image forming method according to claim 1, wherein said toner is a toner selected from the group consisting of a cyan toner, a magenta toner, a yellow toner and a black toner.

6. The image forming method according to claim 5, wherein said toner particles further contain a release agent.

7. The image forming method according to claim 6, wherein said toner particles are produced through the step of granulation in an aqueous medium.

8. The image forming method according to claim 7, wherein said toner particles are produced by suspension polymerization.

9. The image forming method according to claim 7, wherein said toner particles are produced by emulsion agglomeration.

10. The image forming method according to claim 1, wherein;

said toner has a storage elastic modulus at 140° C., G' (140° C.), of from $2.0\times10^3$ dN/m$^2$ or more to less than $1.0\times10^4$ dN/m$^2$; and said toner comes to have a viscosity of $1.0\times10^3$ Pa×s according to the flow tester heating method at a temperature of from 115° C. or more to less than 125° C.

11. An image forming method comprising:

(1) a first charging step of externally applying a voltage to a first charging member to charge a first electrostatic latent image bearing member;

a first latent image formation step of forming a first electrostatic latent image on the first electrostatic latent image bearing member thus charged;

a first developing step of bringing a toner layer formed of a first toner held on the surface of a first toner carrying member, into contact with the surface of the first electrostatic latent image bearing member to develop the first electrostatic latent image with the first toner to form a first toner image on the first electrostatic latent image bearing member; and a first transfer step of transferring the first toner image to a transfer material via, or not via, an intermediate transfer member;

said first toner being selected from the group consisting of a cyan toner, a magenta toner, a yellow toner and a black toner;

(2) a second charging step of externally applying a voltage to a second charging member to charge a second electrostatic latent image bearing member;

a second latent image formation step of forming a second electrostatic latent image on the second electrostatic latent image bearing member thus charged;

a second developing step of bringing a toner layer formed of a second toner held on the surface of a second toner carrying member, into contact with the surface of the second electrostatic latent image bearing member to develop the second electrostatic latent image with the second toner to form a second toner image on the second electrostatic latent image bearing member; and a second transfer step of transferring the second toner image to the transfer material via, or not via, the intermediate transfer member;

said second toner being selected from the group consisting of a cyan toner, a magenta toner, a yellow toner and a black toner, and being different from the first toner;

(3) a third charging step of externally applying a voltage to a third charging member to charge a third electrostatic latent image bearing member;

a third latent image formation step of forming a third electrostatic latent image on the third electrostatic latent image bearing member thus charged;

a third developing step of bringing a toner layer formed of a third toner held on the surface of a third toner carrying member, into contact with the surface of the third electrostatic latent image bearing member to develop the third electrostatic latent image with the third toner to form a third toner image on the third electrostatic latent image bearing member; and a third transfer step of transferring the third toner image to the transfer material via, or not via, the intermediate transfer member;

said third toner being selected from the group consisting of a cyan toner, a magenta toner, a yellow toner and a black toner, and being different from the first toner and the second toner;

(4) a fourth charging step of externally applying a voltage to a fourth charging member to charge a fourth electrostatic latent image bearing member;

a fourth latent image formation step of forming a fourth electrostatic latent image on the fourth electrostatic latent image bearing member thus charged;

a fourth developing step of bringing a toner layer formed of a fourth toner held on the surface of a fourth toner carrying member, into contact with the surface of the fourth electrostatic latent image bearing member to develop the fourth electrostatic latent image with the fourth toner to form a fourth toner image on the fourth electrostatic latent image bearing member; and a fourth transfer step of transferring the fourth toner image to the transfer material via, or not via, the intermediate transfer member;

said fourth toner being selected from the group consisting of a cyan toner, a magenta toner, a yellow toner and a black toner, and being different from the first toner, the second toner and the third toner;

(5) a heat-and-pressure fixing step of fixing the first toner image, the second toner image, the third toner image and the fourth toner image which are held on the transfer material, to form a full-color image;

in said fixing step, any point on the transfer material taking 1/24 seconds to 1/8 seconds to pass through a fixing nip; and each of said first toner, said second toner, said third toner and the fourth toner comprising toner particles containing at least a binder resin and a colorant, and inorganic fine particles;

wherein;

said toner particles have a shape factor SF-1 of from 100 or more to less than 130;

each of said first toner, second toner, third toner and fourth toner has a storage elastic modulus at 140° C., G' (140° C.), of from $2.0\times10^3$ dN/m$^2$ or more to less than $2.0\times10^4$ dN/m$^2$;

each of said first toner, second toner, third toner and fourth toner comes to have a viscosity of $1.0\times10^3$ Pa·s according to the flow tester heating method at a temperature of from 115° C. or more to less than 130° C.; and where a wettability of each of said first toner, second toner, third toner and fourth toner to a methanol/water mixed solvent is measured as transmittance of 780 nm wavelength light, the methanol concentration at the time the transmittance is 50% is within the range of from 30% by volume to 60% by volume.

* * * * *

UNITED STATES PATENT AND TRADEMARK OFFICE

CERTIFICATE OF CORRECTION

PATENT NO. : 7,387,860 B2
APPLICATION NO. : 11/758408
DATED : June 17, 2008
INVENTOR(S) : Yuji Moriki et al.

It is certified that error appears in the above-identified patent and that said Letters Patent is hereby corrected as shown below:

COLUMN 25:

Line 3, “elastbmer,” should read --elastomer,--.

COLUMN 31:

Line 59, “of 7.6 ìm. 100 parts” should read --of 7.6 ìm. ¶ 100 parts--.

COLUMN 33:

Line 14, "of 7.4 ìm. 100 parts" should read --of 7.4 ìm. ¶ 100 parts--.
Line 20, "toner)" should read --toner).--.

Signed and Sealed this

Ninth Day of December, 2008

JON W. DUDAS
*Director of the United States Patent and Trademark Office*